US011159886B2

(12) United States Patent
Hayashi et al.

(10) Patent No.: US 11,159,886 B2
(45) Date of Patent: Oct. 26, 2021

(54) ACOUSTIC DEVICE

(71) Applicant: Sony Corporation, Tokyo (JP)

(72) Inventors: Shigetoshi Hayashi, Tokyo (JP); Ryutaro Watanabe, Tokyo (JP); Tetsunori Itabashi, Kanagawa (JP); Toru Nakagawa, Chiba (JP); Takuma Domae, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/959,793

(22) PCT Filed: Jan. 10, 2019

(86) PCT No.: PCT/JP2019/000602
§ 371 (c)(1),
(2) Date: Jul. 2, 2020

(87) PCT Pub. No.: WO2019/139103
PCT Pub. Date: Jul. 18, 2019

(65) Prior Publication Data

US 2020/0374631 A1 Nov. 26, 2020

(30) Foreign Application Priority Data

Jan. 12, 2018 (JP) ..... JP2018-003187

(51) Int. Cl.
*H04R 5/02* (2006.01)
*H04R 1/02* (2006.01)

(52) U.S. Cl.
CPC ..... *H04R 5/02* (2013.01); *H04R 1/025* (2013.01)

(58) Field of Classification Search
CPC ..... H04R 5/02; H04R 1/025; H04R 2499/13; G10K 11/178; G10K 2210/128; G10K 2210/1282; G10K 2210/3221
See application file for complete search history.

(56) References Cited

U.S. PATENT DOCUMENTS 5,887,071 A * 3/1999 House ..... H04R 5/02 381/386
7,440,578 B2 10/2008 Arai et al.
(Continued)

FOREIGN PATENT DOCUMENTS

CN 102811406 A 12/2012
CN 105191348 A 12/2015
(Continued)

OTHER PUBLICATIONS

International Search Report and Written Opinion dated Mar. 12, 2019 in connection with International Application No. PCT/JP2018/045377, and English translation thereof.
(Continued)

*Primary Examiner* — Jason R Kurr
(74) *Attorney, Agent, or Firm* — Wolf, Greenfield & Sacks, P.C.

(57) ABSTRACT

To favorably reduce crosstalk components output from respective speakers that reproduce left and right ear signals. Directivity is given to a left ear signal and a right ear signal and the left ear signal and the right ear signal are reproduced by using at least two respective speakers arranged back-to-back to reduce crosstalk components. For example, the speaker may be a speaker installed in a headrest or a seat provided with the headrest. For example, the directivity given to the left ear signal and the directivity given to the right ear signal may be bidirectional directivity or unidirectional directivity.

8 Claims, 10 Drawing Sheets

(56) References Cited

U.S. PATENT DOCUMENTS

| | | | | |
|---|---|---|---|---|
| 8,483,413 | B2 * | 7/2013 | Hartung | H04S 7/30 381/302 |
| 10,531,195 | B2 * | 1/2020 | Vautin | H03G 3/3005 |
| 2007/0116298 | A1 | 5/2007 | Holmi et al. | |
| 2008/0273713 | A1 | 11/2008 | Hartung | |
| 2012/0008806 | A1 * | 1/2012 | Hess | H04R 1/345 381/302 |
| 2017/0013386 | A1 | 1/2017 | Vautin et al. | |
| 2017/0053636 | A1 * | 2/2017 | Oswald | H03G 3/20 |
| 2017/0096099 | A1 | 4/2017 | Matsubara et al. | |
| 2018/0122355 | A1 | 5/2018 | Oswald et al. | |
| 2019/0110152 | A1 * | 4/2019 | Lam | H04S 7/301 |

FOREIGN PATENT DOCUMENTS

| | | | |
|---|---|---|---|
| CN | 105210391 | A | 12/2015 |
| EP | 1 788 838 | A2 | 5/2007 |
| EP | 2 405 670 | A1 | 1/2012 |
| JP | 59-041158 | U | 3/1984 |
| JP | 08-19089 | A | 1/1996 |
| JP | 09-46788 | A | 2/1997 |
| JP | 2007-143164 | A | 6/2007 |
| JP | 2012-019506 | A | 1/2012 |
| JP | 2017-071240 | A | 4/2017 |
| WO | WO 2017/007665 | A1 | 1/2017 |
| WO | WO 2017/030920 | A1 | 2/2017 |

OTHER PUBLICATIONS

International Search Report and Written Opinion dated Mar. 26, 2019 in connection with International Application No. PCT/JP2019/000602, and English translation thereof.

International Preliminary Report on Patentability dated Jul. 2, 2020 in connection with International Application No. PCT/JP2018/045377, and English translation thereof.

International Preliminary Report on Patentability dated Jul. 23, 2020 in connection with International Application No. PCT/JP2019/000602, and English translation thereof.

* cited by examiner

ACOUSTIC DEVICE

CROSS-REFERENCE TO RELATED APPLICATIONS

This application claims the benefit under 35 U.S.C. § 371 as a U.S. National Stage Entry of International Application No. PCT/JP2019/000602, filed in the Japanese Patent Office as a Receiving office on Jan. 10, 2019, which claims priority to Japanese Patent Application Number JP2018-003187, filed in the Japanese Patent Office on Jan. 12, 2018, each of which is hereby incorporated by reference in its entirety.

TECHNICAL FIELD

The present technology relates to acoustic devices. In particular, the present technology relates to an acoustic device that reduces crosstalk components output from respective speakers for reproducing left and right ear signals.

BACKGROUND ART

Stereophonic reproduction systems (virtual surround systems) using headrest speakers have been conventionally proposed. Such a stereophonic reproduction system achieves virtual surround by using two headrest speakers including a left headrest speaker and a right headrest speaker. To achieve such a stereophonic reproduction system, it is necessary to reduce crosstalk components.

For example, Patent Literature 1 proposes a loudspeaker system that uses a speaker array to reproduce a user-specific audio signal for each seat. The technology proposed by Patent Literature 1 allows different users to hear different audio signals by using directivity formed through signal processing performed on the speaker array. However, the loudspeaker array is necessary for this technology and this technology is subject to restriction of position in such a manner that the speaker array should be arranged between at least two of listening positions.

CITATION LIST

Patent Literature

Patent Literature 1: Japanese Unexamined Patent Application Publication No. 2017-523654

DISCLOSURE OF INVENTION

Technical Problem

A purpose of the present technology is to favorably reduce crosstalk components output from respective speakers that reproduce left and right ear signals.

Solution to Problem

A concept of the present technique resides in an acoustic device that gives directivity to each of a left ear signal and a right ear signal and reproduces each of the left ear signal and the right ear signal by using at least two respective speakers arranged back-to-back to reduce a crosstalk component.

According to the present technology, directivity is given to a left ear signal and a right ear signal and the left ear signal and the right ear signal are reproduced by using at least two respective speakers arranged back-to-back to reduce crosstalk components. For example, the speaker may be a speaker installed in a headrest or a seat provided with the headrest. For example, the directivity given to the left ear signal and the directivity given to the right ear signal may be bidirectional directivity or unidirectional directivity.

For example, the two speakers arranged back-to-back may include a primary speaker and a secondary speaker for forming directivity, a primary speaker for reproducing the left ear signal and a primary speaker for reproducing the right ear signal may be arranged at a predetermined interval in a first direction, a secondary speaker for reproducing the left ear signal may be arranged at the same position as the primary speaker for reproducing the left ear signal in the first direction, and a secondary speaker for reproducing the right ear signal may be arranged at the same position as the primary speaker for reproducing the right ear signal in the first direction.

Alternatively, for example, the two speakers arranged back-to-back may include a primary speaker and a secondary speaker for forming directivity, a primary speaker for reproducing the left ear signal and a primary speaker for reproducing the right ear signal may be arranged at a predetermined interval in a first direction, a secondary speaker for reproducing the left ear signal may be arranged at a position closer to the primary speaker for reproducing the right ear signal than the primary speaker for reproducing the left ear signal in the first direction, and a secondary speaker for reproducing the right ear signal may be arranged at a position closer to the primary speaker for reproducing the left ear signal than the primary speaker for reproducing the right ear signal in the first direction. In this case, for example, the secondary speaker for reproducing the left ear signal and the secondary speaker for reproducing the right ear signal may be the same speaker.

Alternatively, for example, the two speakers arranged back-to-back may include a primary speaker and a secondary speaker for forming directivity, a primary speaker for reproducing the left ear signal and a primary speaker for reproducing the right ear signal may be arranged at a predetermined interval in a first direction, a secondary speaker for reproducing the left ear signal may be arranged at the same position as the primary speaker for reproducing the right ear signal in the first direction, and a secondary speaker for reproducing the right ear signal may be arranged at the same position as the primary speaker for reproducing the left ear signal in the first direction.

Alternatively, for example, the two speakers arranged back-to-back may include a primary speaker and a secondary speaker for forming directivity, a primary speaker for reproducing the left ear signal and a primary speaker for reproducing the right ear signal may be arranged at a predetermined interval in a first direction, the primary speaker for reproducing the left ear signal may also serve as a secondary speaker for reproducing the right ear signal, and the primary speaker for reproducing the right ear signal may also serve as a secondary speaker for reproducing the left ear signal.

Alternatively, for example, the two speakers arranged back-to-back may include a primary speaker and a secondary speaker for forming directivity, a primary speaker for reproducing the left ear signal and a primary speaker for reproducing the right ear signal may be arranged at a predetermined interval in a first direction, a first secondary speaker may be arranged at the same position as the primary speaker for reproducing the left ear signal in the first direction and a second secondary speaker may be arranged at the same position as the primary speaker for reproducing the right ear signal in the first direction, the first secondary speaker may be used as a secondary speaker for middle and high frequencies of the left ear reproduction signal and a secondary speaker for a low frequency of the right ear reproduction signal, and the second secondary speaker may be used as a secondary speaker for middle and high frequencies of the right ear reproduction signal and a secondary speaker for a low frequency of the left ear reproduction signal. In this case, for example, the secondary speaker for the middle and high frequencies may form unidirectional directivity or bidirectional directivity, and the secondary speaker for the low frequency may form bidirectional directivity.

As described above, according to the present technology, directivity is given to a left ear signal and a right ear signal and the left ear signal and the right ear signal are reproduced by using at least two respective speakers arranged back-to-back to reduce crosstalk components. Therefore, many loudspeakers such as a speaker array is not necessary for the present technology, the present technology is not subject to restriction of position with regard to arrangement of speakers, and it is possible to favorably reduce crosstalk components.

Advantageous Effects of Invention

According to the present technology, it is possible to favorably reduce crosstalk components output from respective speakers that reproduce left and right ear signals. Note that, the effects described herein are not necessarily limited and may be any of the effects described in the present disclosure.

MODE(S) FOR CARRYING OUT THE INVENTION

Modes for carrying out the present invention (hereafter, referred to as "embodiments") will be described below. Note that, the description will be given in the following order.

1. Embodiments
2. Modification

1. EMBODIMENTS

[Acoustic Device]

First Embodiment

Figure 1:
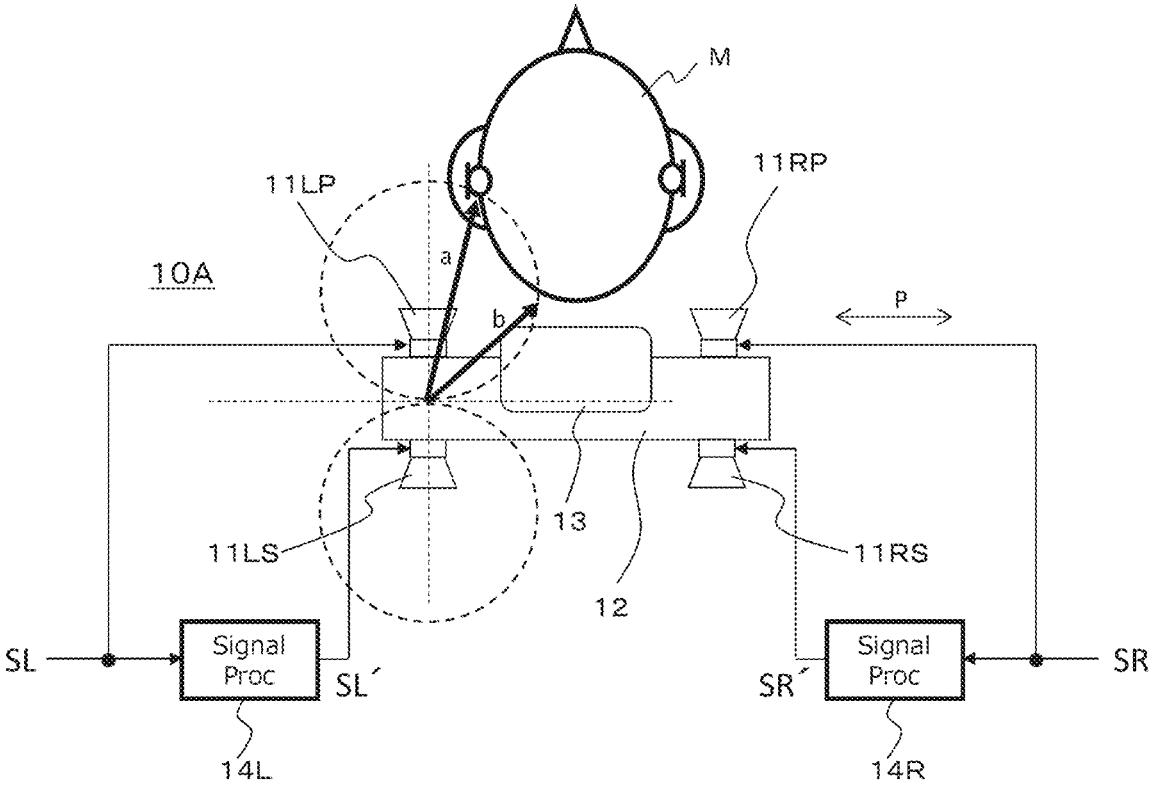
FIG. 1 is a diagram illustrating a configuration example of an acoustic device according to a first embodiment.

FIG. 1 illustrates a configuration example of an acoustic device 10A according to a first embodiment. The acoustic device 10A includes a speaker installation member 12 provided with speakers 11LP, 11LS, 11RP, and 11RS. For example, the speaker installation member 12 is fixed to a headrest 13 attached to an upper central portion of a seat back (not illustrated) of a vehicle seat that is a seat installed in a vehicle. Note that, the speaker installation member 12 may be fixed to the seat back. Alternatively, the speaker installation member 12 may be integrated with the headrest 13 or the seat back of the seat.

The speakers 11LP and 11LS are speakers for reproducing a left ear signal, and the speakers 11LP and 11LS constitute two speakers arranged back-to-back to give directivity. The speaker 11LP constitutes a primary speaker for reproducing the left ear signal, and is installed on a left front surface of the speaker installation member 12. In addition, the speaker 11LS constitutes a secondary speaker for reproducing the left ear signal, and is installed on a left back surface of the speaker installation member 12.

The speakers 11RP and 11RS are speakers for reproducing a right ear signal, and the speakers 11RP and 11RS constitute two speakers arranged back-to-back to give directivity. The speaker 11RP constitutes a primary speaker for reproducing the right ear signal, and is installed on a right front surface of the speaker installation member 12. In addition, the speaker 11RS constitutes a secondary speaker for reproducing the right ear signal, and is installed on a right back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11LS is arranged at the same position as the speaker 11LP in the first direction. In addition, the speaker 11RS is arranged at the same position as the speaker 11RP in the first direction. Note that, the wording "same position" described herein does not have to mean exactly the same position. Some minor deviations are allowed.

The speaker 11LP is driven by a left ear signal SL for stereophonic reproduction (virtual surround). The speaker 11LS is driven by a reversed-phase signal SL' obtained from the left ear signal SL by a signal processor 14L. In this case, the signal processor 14L adjusts the level of the reversed-phase signal SL' in such a manner that the speakers 11LP and 11LS reproduce the left ear signal with bidirectional directivity.

In addition, the speaker 11RP is driven by a right ear signal SR for stereophonic reproduction (virtual surround). The speaker 11RS is driven by a reversed-phase signal SR' obtained from the right ear signal SR by a signal processor 14R. In this case, the signal processor 14R adjusts the level of the reversed-phase signal SR' in such a manner that the speakers 11RP and 11RS reproduce the right ear signal with bidirectional directivity.

In FIG. 1, dashed lines indicate the bidirectional directivity of the left ear signal reproduced by the speakers 11LP and 11LS. Note that, to simplify the drawing, the bidirectional directivity of the right ear signal reproduced by the speakers 11RP and 11RS are not illustrated.

Figure 2:
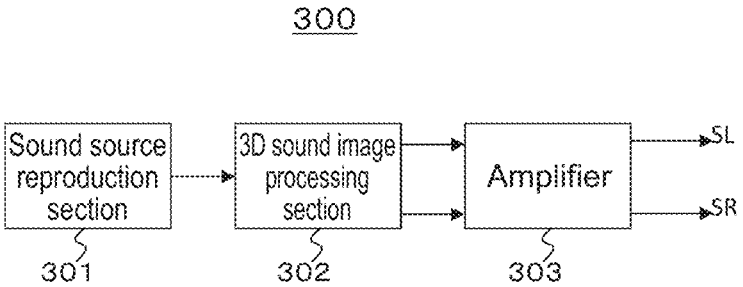
FIG. 2 is a block diagram illustrating a configuration example of a signal processing device that generates a left ear signal and a right ear signal for stereophonic reproduction (virtual surround).

FIG. 2 illustrates a configuration example of a signal processing device 300 that generates the left ear signal SL and the right ear signal SR for stereophonic reproduction (virtual surround). The signal processing device 300 includes a sound source reproduction section 301, a 3D sound image processing section 302, and an amplifier 303. The sound source reproduction section 301 reproduces 5-channel sound signals, 7-channel sound signals, or the like that constitute a surround sound signal, for example. Such channel sound signals are supplied to the 3D sound image processing section 302.

The 3D sound image processing section 302 performs virtual sound image localization processing on the respective channel sound signals, and generates the left ear signal and the right ear signal. The amplifier 303 amplifies the left ear signal obtained by the 3D sound image processing section 302, and the left ear signal becomes the left ear signal SL. In addition, the amplifier 303 amplifies the right ear signal obtained by the 3D sound image processing section 302, and the right ear signal becomes the right ear signal SR.

The acoustic device 10A illustrated in FIG. 1 reproduces the left ear signal with bidirectional directivity by using the speakers 11LP and 11LS arranged back-to-back. Therefore, with regard to the left ear signal reproduced by the speakers 11LP and 11LS, the level of sound that propagates toward a right ear direction of the listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10A reproduces the right ear signal with bidirectional directivity by using the speakers 11RP and 11RS arranged back-to-back. This also makes it possible to reduce a crosstalk component related to the right ear signal in a similar way.

As described above, the acoustic device 10A illustrated in FIG. 1 uses the two speakers arranged back-to-back to reproduce each of the left ear signal and the right ear signal with bidirectional directivity and to reduce crosstalk components. Therefore, many loudspeakers such as a speaker array are not necessary for the acoustic device 10A, the acoustic device 10A is not subject to restriction of position with regard to arrangement of speakers unlike in the case of using the speaker array, and it is possible to favorably reduce crosstalk components and achieve favorable stereophonic reproduction (virtual surround).

Second Embodiment

Figure 3:
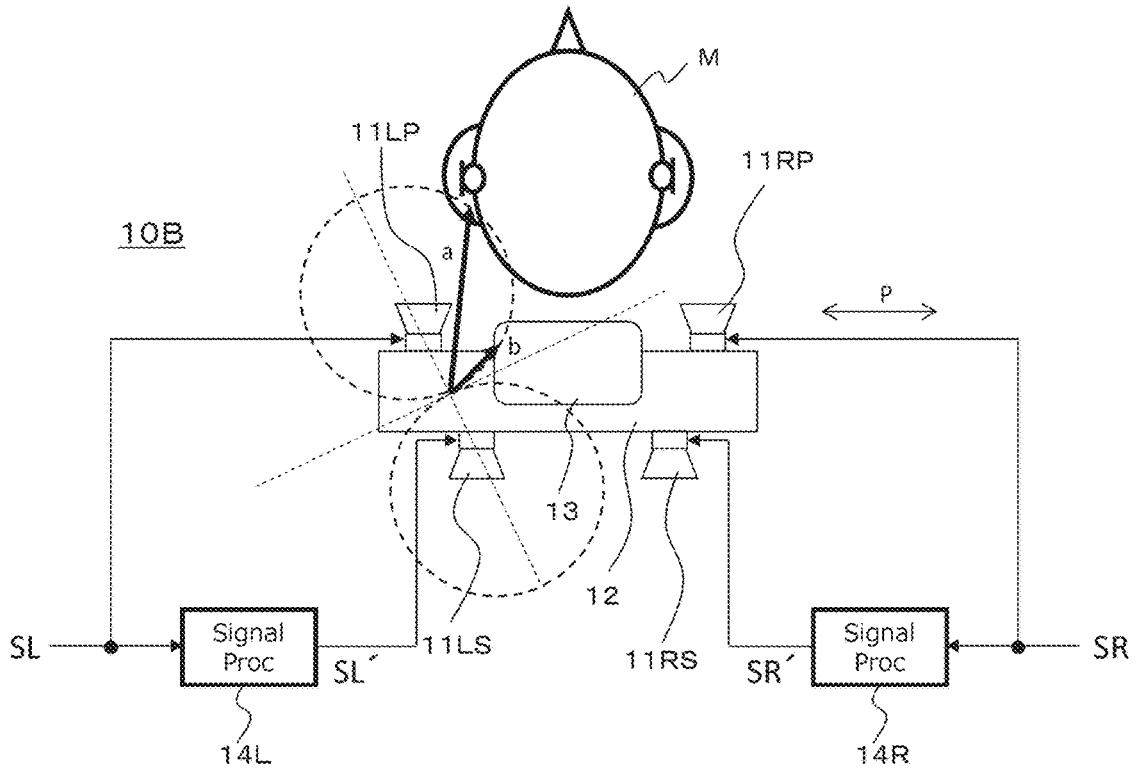
FIG. 3 is a diagram illustrating a configuration example of an acoustic device according to a second embodiment.

FIG. 3 illustrates a configuration example of an acoustic device 10B according to a second embodiment. In FIG. 3, structural elements similar to FIG. 1 are denoted with the same reference signs as FIG. 1, and detailed description thereof will be omitted appropriately. The acoustic device 10B includes the speaker installation member 12 provided with the speakers 11LP, 11LS, 11RP, an 11RS. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speakers 11LP and 11LS are speakers for reproducing the left ear signal, and the speakers 11LP and 11LS constitute two speakers arranged back-to-back to give directivity. The speaker 11LP constitutes a primary speaker for reproducing the left ear signal, and is installed on the left front surface of the speaker installation member 12. In addition, the speaker 11LS constitutes a secondary speaker for reproducing the left ear signal, and is installed on the left back surface of the speaker installation member 12.

The speakers 11RP and 11RS are speakers for reproducing the right ear signal, and the speakers 11RP and 11RS constitute two speakers arranged back-to-back to give directivity. The speaker 11RP constitutes a primary speaker for reproducing the right ear signal, and is installed on the right front surface of the speaker installation member 12. In addition, the speaker 11RS constitutes a secondary speaker for reproducing the right ear signal, and is installed on the right back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11LS is arranged at a position closer to a speaker 11RP side than the speaker 11LP in the first direction. In addition, the speaker 11RS is arranged at a position closer to a speaker 11LP side than the speaker 11RP in the first direction.

The speaker 11LP is driven by the left ear signal SL for stereophonic reproduction (virtual surround). The speaker 11LS is driven by the reversed-phase signal SL' obtained from the left ear signal SL by the signal processor 14L. In this case, the signal processor 14L adjusts the level of the reversed-phase signal SL' in such a manner that the speakers 11LP and 11LS reproduce the left ear signal with bidirectional directivity.

In addition, the speaker 11RP is driven by the right ear signal SR for stereophonic reproduction (virtual surround). The speaker 11RS is driven by the reversed-phase signal SR' obtained from the right ear signal SR by the signal processor 14R. In this case, the signal processor 14R adjusts the level of the reversed-phase signal SR' in such a manner that the speakers 11RP and 11RS reproduce the right ear signal with bidirectional directivity.

In FIG. 3, dashed lines indicate the bidirectional directivity of the left ear signal reproduced by the speakers 11LP and 11LS. Note that, to simplify the drawing, the bidirectional directivity of the right ear signal reproduced by the speakers 11RP and 11RS are not illustrated.

The acoustic device 10B illustrated in FIG. 3 reproduces the left ear signal with bidirectional directivity by using the speakers 11LP and 11LS arranged back-to-back. Therefore, with regard to the left ear signal reproduced by the speakers 11LP and 11LS, the level of sound that propagates toward a right ear direction of the listener M (indicated by an arrow b) becomes lower than the level of sound that propagates toward a left ear direction of the listener M (indicated by an arrow a), and this makes it possible to reduce a crosstalk component related to the left ear signal.

In this case, the speaker 11LS is arranged at the position closer to the speaker 11RP side than the speaker 11LP in the first direction. Accordingly, a direction of a null regarding the bidirectional directivity gets closer to the right ear direction. This makes it possible to reduce the level of sound that propagates toward the right ear direction than the acoustic device 10A illustrated in FIG. 1, and this makes it possible to reduce the crosstalk component related to the left ear signal more. In addition, the acoustic device 10B reproduces the right ear signal with bidirectional directivity by using the speakers 11RP and 11RS arranged back-to-back. This also makes it possible to reduce a crosstalk component related to the right ear signal in a similar way.

As described above, the acoustic device 10B illustrated in FIG. 3 also uses the two speakers arranged back-to-back to reproduce each of the left ear signal and the right ear signal with bidirectional directivity and to reduce crosstalk components. Therefore, many loudspeakers such as a speaker array are not necessary for the acoustic device 10B, the acoustic device 10B is not subject to restriction of position with regard to arrangement of speakers unlike in the case of using the speaker array, and it is possible to favorably reduce crosstalk components and achieve favorable stereophonic reproduction (virtual surround).

Third Embodiment

Figure 4:
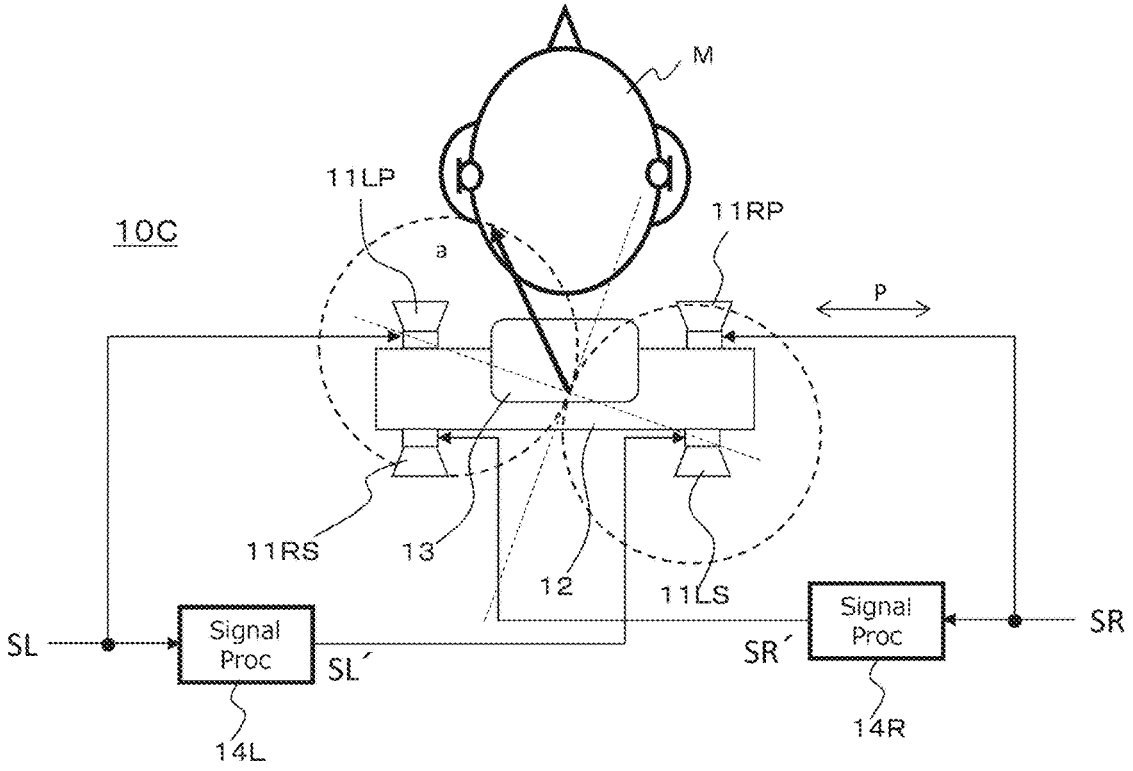
FIG. 4 is a diagram illustrating a configuration example of an acoustic device according to a third embodiment.

FIG. 4 illustrates a configuration example of an acoustic device 10C according to a third embodiment. In FIG. 4, structural elements similar to FIG. 1 are denoted with the same reference signs as FIG. 1, and detailed description thereof will be omitted appropriately. The acoustic device 10C includes the speaker installation member 12 provided with the speakers 11LP, 11LS, 11RP and 11RS. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speakers 11LP and 11LS are speakers for reproducing the left ear signal, and the speakers 11LP and 11LS constitute two speakers arranged back-to-back to give directivity. The speaker 11LP constitutes a primary speaker for reproducing the left ear signal, and is installed on the left front surface of the speaker installation member 12. In addition, the speaker 11LS constitutes a secondary speaker for reproducing the left ear signal, and is installed on the right back surface of the speaker installation member 12.

The speakers 11RP and 11RS are speakers for reproducing the right ear signal, and the speakers 11RP and 11RS constitute two speakers arranged back-to-back to give directivity. The speaker 11RP constitutes a primary speaker for reproducing the right ear signal, and is installed on the right front surface of the speaker installation member 12. In addition, the speaker 11RS constitutes a secondary speaker for reproducing the right ear signal, and is installed on the left back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11LS is arranged at the same position as the speaker 11RP in the first direction. In addition, the speaker 11RS is arranged at the same position as the speaker 11LP in the first direction. Note that, the wording "same position" described herein does not have to mean exactly the same position. Some minor deviations are allowed.

The speaker 11LP is driven by the left ear signal SL for stereophonic reproduction (virtual surround). The speaker 11LS is driven by the reversed-phase signal SL' obtained from the left ear signal SL by the signal processor 14L. In this case, the signal processor 14L adjusts the level of the reversed-phase signal SL' in such a manner that the speakers 11LP and 11LS reproduce the left ear signal with bidirectional directivity.

In addition, the speaker 11RP is driven by the right ear signal SR for stereophonic reproduction (virtual surround). The speaker 11RS is driven by a reversed-phase signal SR' obtained from the right ear signal SR by the signal processor 14R. In this case, the signal processor 14R adjusts the level of the reversed-phase signal SR' in such a manner that the speakers 11RP and 11RS reproduce the right ear signal with bidirectional directivity.

In FIG. 4, dashed lines indicate the bidirectional directivity of the left ear signal reproduced by the speakers 11LP and 11LS. Note that, to simplify the drawing, the bidirectional directivity of the right ear signal reproduced by the speakers 11RP and 11RS are not illustrated.

The acoustic device 10C illustrated in FIG. 4 reproduces the left ear signal with bidirectional directivity by using the speakers 11LP and 11LS arranged back-to-back. Therefore, with regard to the left ear signal reproduced by the speakers 11LP and 11LS, the level of sound that propagates toward a right ear direction of the listener M becomes lower than the level of sound that propagates toward a left ear direction of the listener M (indicated by an arrow a), and this makes it possible to reduce a crosstalk component related to the left ear signal.

In this case, the speaker 11LS is arranged at the same position as the speaker 11RP in the first direction. Accordingly, a direction of a null regarding the bidirectional directivity is almost identical to the right ear direction. This makes it possible to reduce the level of sound that propagates toward the right ear direction to almost zero, and this makes it possible to drastically reduce the crosstalk component related to the left ear signal. In addition, the acoustic device 10C reproduces the right ear signal with bidirectional directivity by using the speakers 11RP and 11RS arranged back-to-back. This also makes it possible to reduce a crosstalk component related to the right ear signal in a similar way.

As described above, the acoustic device 10C illustrated in FIG. 4 also uses the two speakers arranged back-to-back to reproduce each of the left ear signal and the right ear signal with bidirectional directivity and to reduce crosstalk components. Therefore, many loudspeakers such as a speaker array are not necessary for the acoustic device 10C, the acoustic device 10C is not subject to restriction of position with regard to arrangement of speakers unlike in the case of using the speaker array, and it is possible to favorably reduce crosstalk components and achieve favorable stereophonic reproduction (virtual surround).

Note that, in the case where the two speakers arranged back-to-back are used and the distance between the speakers is constant, it becomes easier to form the directivity as the reproduction signal has a lower frequency. In other words, when the distance between the speakers gets longer, it is difficult to form the directivity at a high frequency. In the case of the acoustic device 10C illustrated in FIG. 4, the distance between the two speakers arranged back-to-back is long. Such a distance may make it difficult to form the directivity with regard to a high frequency component of the reproduction signal.

Fourth Embodiment

Figure 5:
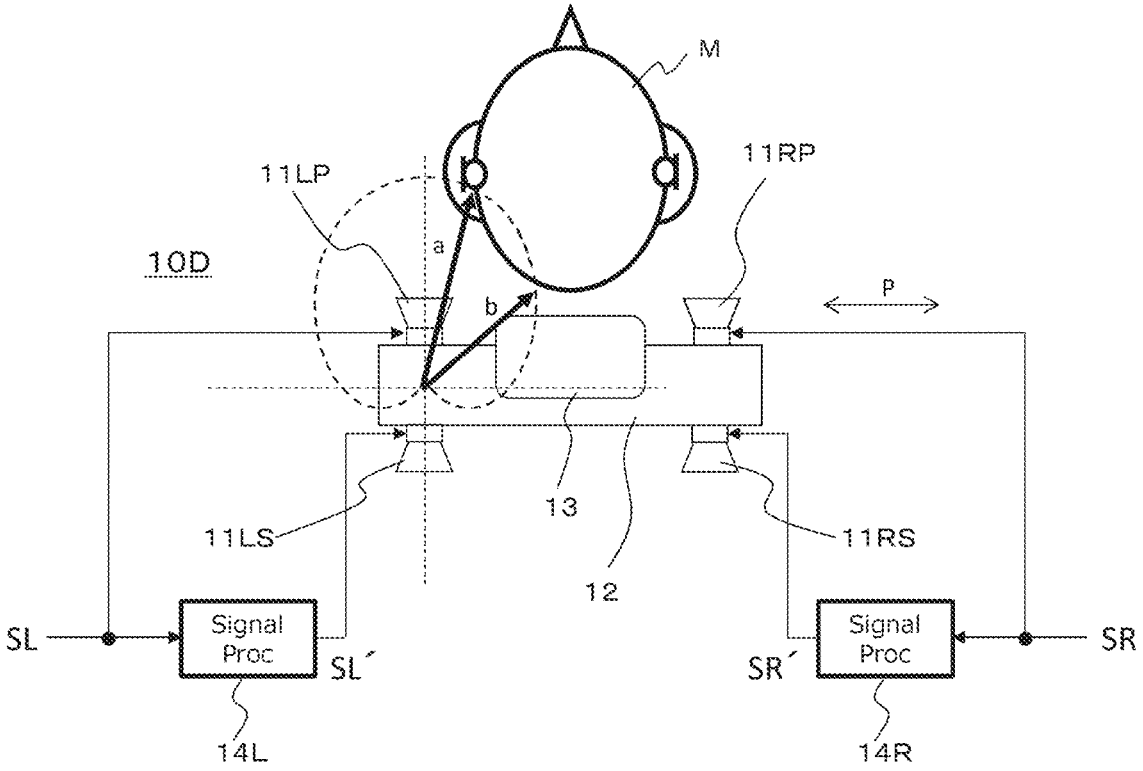
FIG. 5 is a diagram illustrating a configuration example of an acoustic device according to a fourth embodiment.

FIG. 5 illustrates a configuration example of an acoustic device 10D according to a fourth embodiment. In FIG. 5, structural elements similar to FIG. 1 are denoted with the same reference signs as FIG. 1, and detailed description thereof will be omitted appropriately. The acoustic device 10D includes the speaker installation member 12 provided with the speakers 11LP, 11LS, 11RP, and 11RS. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speakers 11LP and 11LS are speakers for reproducing the left ear signal, and the speakers 11LP and 11LS constitute two speakers arranged back-to-back to give directivity. The speaker 11LP constitutes a primary speaker for reproducing the left ear signal, and is installed on the left front surface of the speaker installation member 12. In addition, the speaker 11LS constitutes a secondary speaker for reproducing the left ear signal, and is installed on the left back surface of the speaker installation member 12.

The speakers 11RP and 11RS are speakers for reproducing the right ear signal, and the speakers 11RP and 11RS constitute two speakers arranged back-to-back to give directivity. The speaker 11RP constitutes a primary speaker for reproducing the right ear signal, and is installed on the right front surface of the speaker installation member 12. In addition, the speaker 11RS constitutes a secondary speaker for reproducing the right ear signal, and is installed on the right back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11LS is arranged at the same position as the speaker 11RP in the first direction. In addition, the speaker 11RS is arranged at the same position as the speaker 11LP in the first direction. Note that, the wording "same position" described herein does not have to mean exactly the same position. Some minor deviations are allowed.

The speaker 11LP is driven by the left ear signal SL for stereophonic reproduction (virtual surround). The speaker 11LS is driven by the reversed-phase signal SL' obtained from the left ear signal SL by the signal processor 14L. In this case, the signal processor 14L adjusts the level of the reversed-phase signal SL' in such a manner that the speakers 11LP and 11LS reproduce the left ear signal with unidirectional directivity.

In addition, the speaker 11RP is driven by the right ear signal SR for stereophonic reproduction (virtual surround). The speaker 11RS is driven by the reversed-phase signal SR' obtained from the right ear signal SR by the signal processor 14R. In this case, the signal processor 14R adjusts the level of the reversed-phase signal SR' in such a manner that the speakers 11RP and 11RS reproduce the right ear signal with unidirectional directivity.

In FIG. 5, a dashed line indicates the unidirectional directivity of the left ear signal reproduced by the speakers 11LP and 11LS. Note that, to simplify the drawing, the unidirectional directivity of the right ear signal reproduced by the speakers 11RP and 11RS are not illustrated.

The acoustic device 10D illustrated in FIG. 5 reproduces the left ear signal with unidirectional directivity by using the speakers 11LP and 11LS arranged back-to-back. Therefore, with regard to the left ear signal reproduced by the speakers 11LP and 11LS, the level of sound that propagates toward a right ear direction of the listener M becomes lower than the level of sound that propagates toward a left ear direction of the listener M (indicated by an arrow a), and this makes it possible to reduce a crosstalk component related to the left ear signal.

In this case, the left ear signal having the unidirectional directivity is reproduced. Therefore, the level of sound that propagates toward the right ear direction becomes higher than the reproduced sound having the bidirectional directivity like in the case of the acoustic device 10A illustrated in FIG. 1, but it is possible to drastically reduce the level of sound that propagates toward the back surface side. In addition, the acoustic device 10D reproduces the right ear signal with unidirectional directivity by using the speakers 11RP and 11RS arranged back-to-back. This also makes it possible to reduce a crosstalk component related to the right ear signal in a similar way.

As described above, the acoustic device 10D illustrated in FIG. 5 also uses the two speakers arranged back-to-back to reproduce each of the left ear signal and the right ear signal with unidirectional directivity and to reduce crosstalk components. Therefore, many loudspeakers such as a speaker array are not necessary for the acoustic device 10D, the acoustic device 10D is not subject to restriction of position with regard to arrangement of speakers unlike in the case of using the speaker array, and it is possible to favorably reduce crosstalk components and achieve favorable stereophonic reproduction (virtual surround).

Note that, although detailed description will be omitted, the above-described acoustic devices 10B and 10C illustrated in FIG. 3 and FIG. 4 may reproduce the left ear signal and the right ear signal with unidirectional directivity by using the two speakers arranged back-to-back. In this case, it is also possible to favorably reduce crosstalk components in a way similar to the case of the acoustic device 10D illustrated in FIG. 5.

Fifth Embodiment

Figure 6:
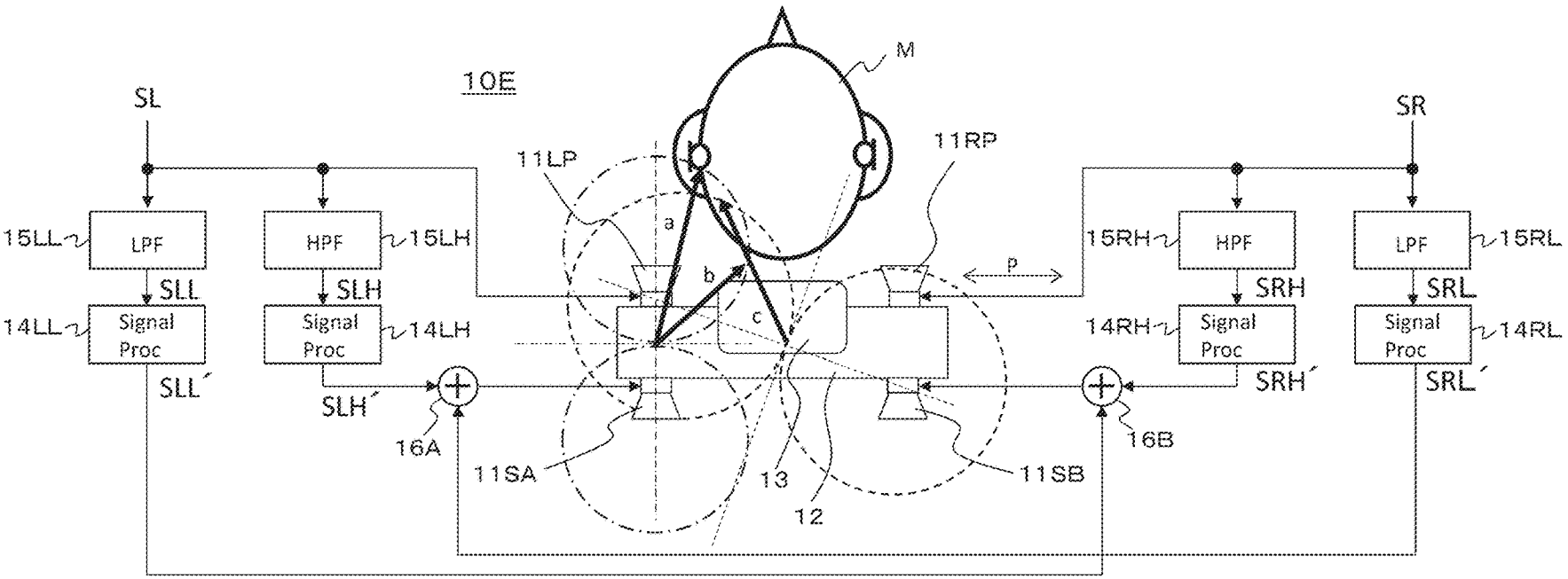
FIG. 6 is a diagram illustrating a configuration example of an acoustic device according to a fifth embodiment.

FIG. 6 illustrates a configuration example of an acoustic device 10E according to a fifth embodiment. In FIG. 6, structural elements similar to FIG. 1 are denoted with the same reference signs as FIG. 1, and detailed description thereof will be omitted appropriately. The acoustic device 10E includes the speaker installation member 12 provided with speakers 11LP, 11RP, 11SA, and 11SB. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speaker 11LP is installed on the left front surface of the speaker installation member 12. The speaker 11RP is installed on the right front surface of the speaker installation member 12. The speaker 11SA is installed on the left back surface of the speaker installation member 12. The speaker 11SB is installed on the right back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11SA is arranged at the same position as the speaker 11LP in the first direction. In addition, the speaker 11SB is arranged at the same position as the speaker 11RP in the first direction. Note that, the wording "same position" described herein does not have to mean exactly the same position. Some minor deviations are allowed.

The speakers 11LP and 11SA are speakers for reproducing middle and high frequencies of the left ear signal, and the speakers 11LP and 11SA constitute two speakers arranged back-to-back to give directivity. In this case, the speaker 11LP constitutes a primary speaker, and the speaker 11SA constitutes a secondary speaker. The speakers 11LP and 11SB are speakers for reproducing a low frequency of the left ear signal, and the speakers 11LP and 11SB constitute two speakers arranged back-to-back to give directivity. In this case, the speaker 11LP constitutes a primary speaker, and the speaker 11SB constitutes a secondary speaker.

The speakers 11RP and 11SB are speakers for reproducing middle and high frequencies of the right ear signal, and the speakers 11RP and 11SB constitute two speakers arranged back-to-back to give directivity. In this case, the speaker 11RP constitutes a primary speaker, and the speaker 11SB constitutes a secondary speaker. The speakers 11RP and 11SA are speakers for reproducing a low frequency of the right ear signal, and the speakers 11RP and 11SA constitute two speakers arranged back-to-back to give directivity. In this case, the speaker 11RP constitutes a primary speaker, and the speaker 11SA constitutes a secondary speaker.

The speaker 11LP is driven by the left ear signal SL including a low frequency component and a middle and high frequency component for stereophonic reproduction (virtual surround). The speaker 11RP is driven by the right ear signal SR including a low frequency component and a middle and high frequency component for the stereophonic reproduction (virtual surround).

A high-pass filter 15LH extracts a middle and high frequency component SLH from the left ear signal SL. Next, a signal processor 14LH processes the middle and high frequency component SLH obtained by the high-pass filter 15LH and generates a reversed-phase signal SLH' with an adjusted level in such a manner that the speakers 11LP and 11SA reproduce the middle and high frequencies of the left ear signal with bidirectional directivity as indicated by dash-dotted lines. Note that, to simplify the drawing, the bidirectional directivity of the middle and high frequencies of the right ear signal reproduced by the speakers 11RP and 11SB (to be described later) are not illustrated.

In addition, a low-pass filter 15LL extracts a low frequency component SLL from the left ear signal SL. Next, a signal processor 14LL processes the low frequency component SLL obtained by the low-pass filter 15LL and generates a reversed-phase signal SLL' with an adjusted level in such a manner that the speakers 11LP and 11SB reproduce the low frequency of the left ear signal with bidirectional directivity as indicated by dashed lines. Note that, to simplify the drawing, the bidirectional directivity of the low frequency of the right ear signal reproduced by the speakers 11RP and 11SA (to be described later) are not illustrated.

A high-pass filter 15RH extracts a middle and high frequency component SRH from the right ear signal SR. Next, a signal processor 14RH processes the middle and high frequency component SRH obtained by the high-pass filter 15RH and generates a reversed-phase signal SRH' with an adjusted level in such a manner that the speakers 11RP and 11SB reproduce the middle and high frequencies of the right ear signal with bidirectional directivity.

In addition, a low-pass filter 15RL extracts a low frequency component SRL from the right ear signal SR. Next, a signal processor 14RL processes the low frequency component SRL obtained by the low-pass filter 15RL and generates a reversed-phase signal SRL' with an adjusted level in such a manner that the speakers 11RP and 11SA reproduce the low frequency of the right ear signal with bidirectional directivity.

An adder 16A adds the reversed-phase signal SLH' obtained by the signal processor 14LH and the reversed-phase signal SRL' obtained by the signal processor 14RL. The speaker 11SA is driven by the addition signal obtained by the adder 16A. In addition, an adder 16B adds the reversed-phase signal SRH' obtained by the signal processor 14RH and the reversed-phase signal SLL' obtained by the signal processor 14LL. The speaker 11SB is driven by the addition signal obtained by the adder 16B.

The acoustic device 10E illustrated in FIG. 6 reproduces the middle and high frequencies of the left ear signal with bidirectional directivity by using the speakers 11LP and 11SA arranged back-to-back. Therefore, with regard to the middle and high frequencies of the left ear signal, the level of sound that propagates toward a right ear direction of a listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10E reproduces the middle and high frequencies of the right ear signal with bidirectional directivity by using the speakers 11RP and 11SB arranged back-to-back. This also makes it possible to reduce a crosstalk component related to the middle and high frequencies of the right ear signal in a similar way.

In addition, the acoustic device 10E reproduces the low frequency of the left ear signal with bidirectional directivity by using the speakers 11LP and 11SB arranged back-to-back. Therefore, with regard to the low frequency of the left ear signal, the level of sound that propagates toward the right ear direction becomes almost zero in comparison with the level of sound that propagates toward the left ear direction of the listener M (indicated by an arrow c), and this makes it possible to drastically reduce a crosstalk component related to the left ear signal. In addition, the acoustic device 10E reproduces the low frequency of the right ear signal with bidirectional directivity by using the speakers 11RP and 11SA arranged back-to-back. This also makes it possible to drastically reduce a crosstalk component related to the low frequency of the right ear signal in a similar way.

As described above, the acoustic device 10E illustrated in FIG. 6 uses the two speakers arranged back-to-back to reproduce each of the left ear signal and the right ear signal with bidirectional directivity and to reduce crosstalk components. In addition, in this case, the two speakers arranged at a short distance are used for the middle and high frequency component. This makes it possible to easily give bidirectional directivity. In addition, in this case, two speakers arranged at a long distance are used for the low frequency component. Therefore, the propagation direction of the crosstalk component becomes closer to the direction of a null regarding the bidirectional directivity, and this makes it possible to drastically reduce the crosstalk component. In addition, many loudspeakers such as a speaker array are not necessary for the acoustic device 10E, the acoustic device 10E is not subject to restriction of position with regard to arrangement of speakers unlike in the case of using the speaker array, and it is possible to favorably reduce crosstalk components and achieve favorable stereophonic reproduction (virtual surround).

Sixth Embodiment

Figure 7:
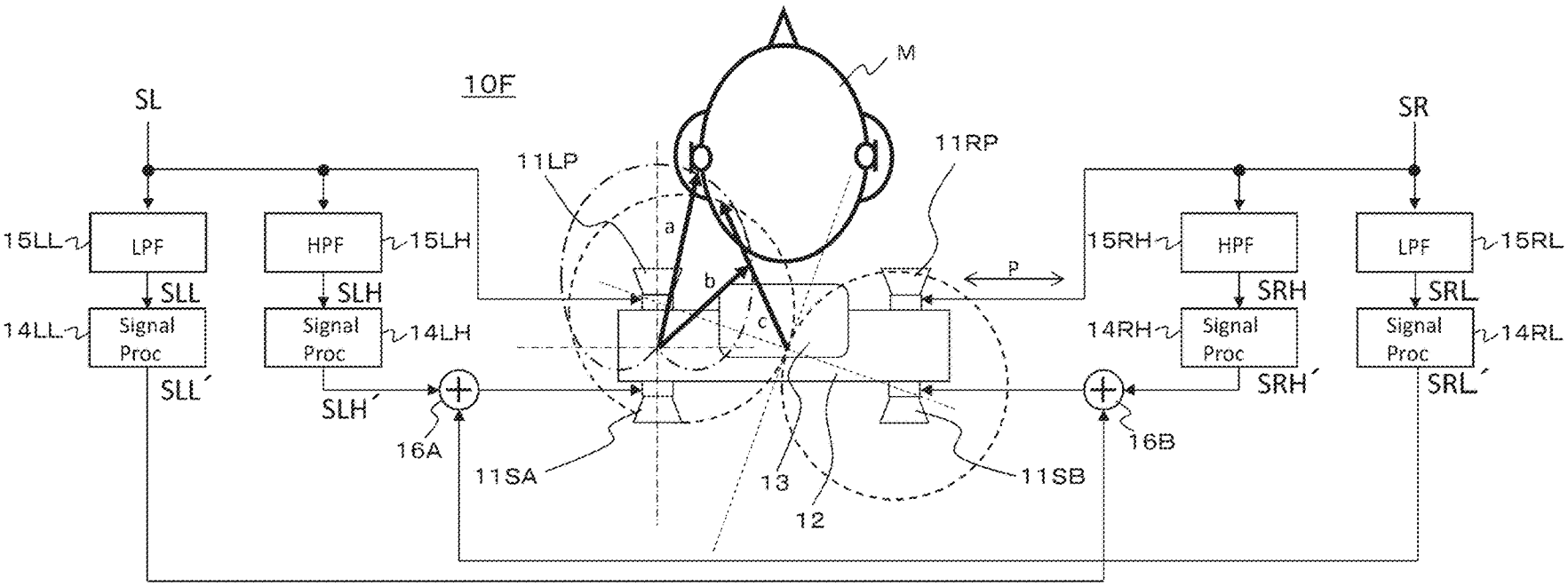
FIG. 7 is a diagram illustrating a configuration example of an acoustic device according to a sixth embodiment.

FIG. 7 illustrates a configuration example of an acoustic device 10F according to a sixth embodiment. In FIG. 7, structural elements similar to FIG. 6 are denoted with the same reference signs as FIG. 6, and detailed description thereof will be omitted appropriately. The acoustic device 10F includes the speaker installation member 12 provided with the speakers 11LP, 11RP, 11SA, and 11SB in a way similar to the acoustic device 10E illustrated in FIG. 6.

The speaker 11LP is driven by the left ear signal SL including the low frequency component and the middle and high frequency component for stereophonic reproduction (virtual surround). The speaker 11RP is driven by the right ear signal SR including the low frequency component and the middle and high frequency component for the stereophonic reproduction (virtual surround).

The signal processor 14LH processes the middle and high frequency component SLH obtained by the high-pass filter 15LH and generate the reversed-phase signal SLH' with an adjusted level in such a manner that the speakers 11LP and 11SA reproduce the middle and high frequencies of the left ear signal with unidirectional directivity as indicated by a dash-dotted line. Note that, to simplify the drawing, the unidirectional directivity of the middle and high frequencies of the right ear signal reproduced by the speakers 11RP and 11SB (to be described later) are not illustrated.

In addition, the signal processor 14LL processes the low frequency component SLL obtained by the low-pass filter 15LL and generates the reversed-phase signal SLL' with an adjusted level in such a manner that the speakers 11LP and 11SB reproduce the low frequency of the left ear signal with bidirectional directivity as indicated by dashed lines. Note that, to simplify the drawing, the bidirectional directivity of the low frequency of the right ear signal reproduced by the speakers 11RP and 11SA (to be described later) are not illustrated.

The signal processor 14RH processes the middle and high frequency component SRH obtained by the high-pass filter 15RH and generates the reversed-phase signal SRH' with an adjusted level in such a manner that the speakers 11RP and 11SB reproduce the middle and high frequencies of the right ear signal with unidirectional directivity. In addition, the signal processor 14RL processes the low frequency component SRL obtained by the low-pass filter 15RL and generates the reversed-phase signal SRL' with an adjusted level in such a manner that the speakers 11RP and 11SA reproduce the low frequency of the right ear signal with bidirectional directivity.

The adder 16A adds the reversed-phase signal SLH' obtained by the signal processor 14LH and the reversed-phase signal SRL' obtained by the signal processor 14RL. The speaker 11SA is driven by the addition signal obtained by the adder 16A. In addition, the adder 16B adds the reversed-phase signal SRH' obtained by the signal processor 14RH and the reversed-phase signal SLL' obtained by the signal processor 14LL. The speaker 11SB is driven by the addition signal obtained by the adder 16B.

The acoustic device 10F illustrated in FIG. 7 reproduces the middle and high frequencies of the left ear signal with unidirectional directivity by using the speakers 11LP and 11SA arranged back-to-back. Therefore, with regard to the middle and high frequencies of the left ear signal, the level of sound that propagates toward a right ear direction of a listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10F reproduces the middle and high frequencies of the right ear signal with bidirectional directivity by using the speakers 11RP and 11SB arranged back-to-back. This also makes it possible to reduce a crosstalk component related to the middle and high frequencies of the right ear signal in a similar way.

In addition, the acoustic device 10F reproduces the low frequency of the left ear signal with bidirectional directivity by using the speakers 11LP and 11SB arranged back-to-back. Therefore, with regard to the low frequency of the left ear signal, the level of sound that propagates toward the right ear direction becomes almost zero in comparison with the level of sound that propagates toward the left ear direction of the listener M (indicated by an arrow c), and this makes it possible to drastically reduce a crosstalk component related to the left ear signal. In addition, the acoustic device 10F reproduces the low frequency of the right ear signal with bidirectional directivity by using the speakers 11RP and 11SA arranged back-to-back. This also makes it possible to drastically reduce a crosstalk component related to the low frequency of the right ear signal in a similar way.

As described above, the acoustic device 10F illustrated in FIG. 7 uses the two speakers arranged back-to-back to reproduce each of the left ear signal and the right ear signal with bidirectional directivity and unidirectional directivity and to reduce crosstalk components. In addition, in this case, the two speakers arranged at a short distance are used for the middle and high frequency component. This makes it possible to easily give unidirectional directivity. In addition, in this case, two speakers arranged at a long distance are used for the low frequency component. Therefore, the propagation direction of the crosstalk component becomes closer to the direction of a null regarding the bidirectional directivity, and this makes it possible to drastically reduce the crosstalk component. In addition, many loudspeakers such as a speaker array are not necessary for the acoustic device 10F, the acoustic device 10F is not subject to restriction of position with regard to arrangement of speakers unlike in the case of using the speaker array, and it is possible to favorably reduce crosstalk components and achieve favorable stereophonic reproduction (virtual surround).

Note that, the acoustic devices 10E and 10F illustrated in FIG. 6 and FIG. 7 give bidirectional directivity to the low frequency. However, although not illustrated, it is also possible to give unidirectional directivity also to the low frequency. In this case, it is also possible to favorably reduce the crosstalk component.

Seventh Embodiment

Figure 8:
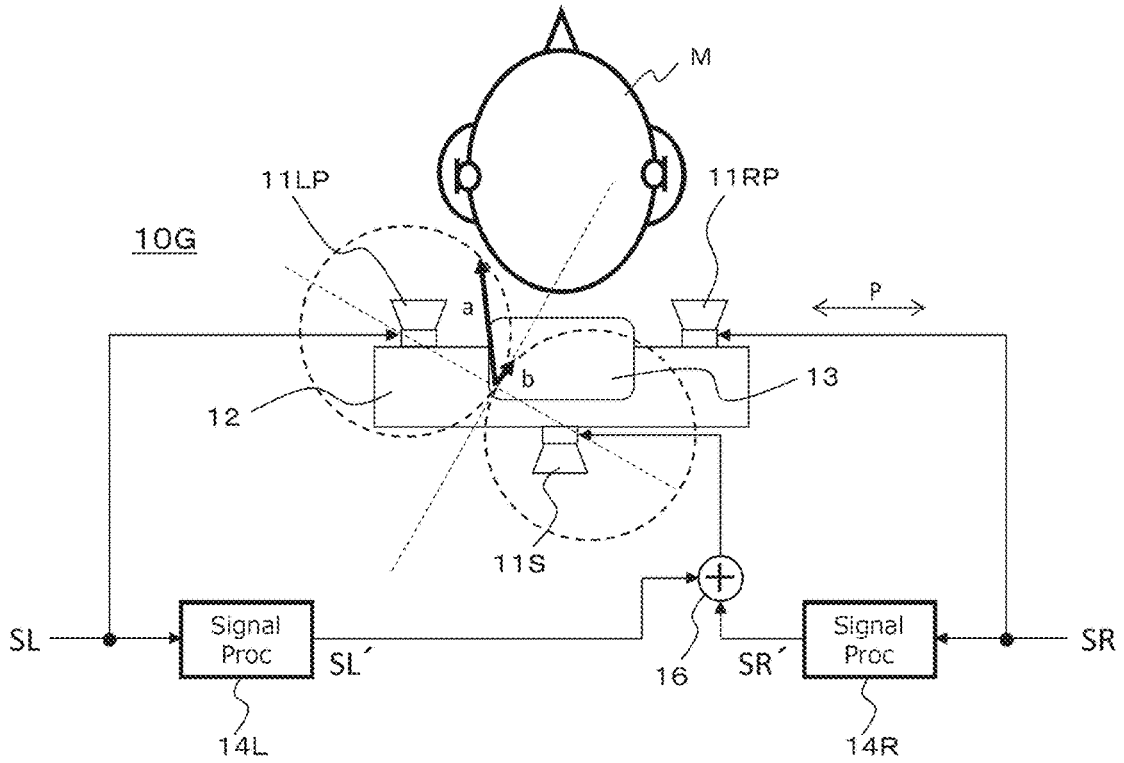
FIG. 8 is a diagram illustrating a configuration example of an acoustic device according to a seventh embodiment.

FIG. 8 illustrates a configuration example of an acoustic device 10G according to a seventh embodiment. In FIG. 8, structural elements similar to FIG. 1 are denoted with the same reference signs as FIG. 1, and detailed description thereof will be omitted appropriately. The acoustic device 10G includes the speaker installation member 12 provided with speakers 11LP, 11RP, and 11S. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speaker 11LP is installed on the left front surface of the speaker installation member 12. The speaker 11RP is installed on the right front surface of the speaker installation member 12. The speaker 11S is installed on a central back surface of the speaker installation member 12.

Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP. The speaker 11S is arranged at an intermediate position between the speaker 11LP and the speaker 11RP in the first direction. Note that, the wording "intermediate position" described herein does not have to mean the exact intermediate position. Some minor deviations are allowed.

The speakers 11LP and 11S are speakers for reproducing the left ear signal, and the speakers 11LP and 11S constitute two speakers arranged back-to-back to give directivity. In this case, the speaker 11LP constitutes a primary speaker, and the speaker 11S constitutes a secondary speaker.

The speakers 11RP and 11S are speakers for reproducing the right ear signal, and the speakers 11RP and 11S constitute two speakers arranged back-to-back to give directivity. In this case, the speaker 11RP constitutes a primary speaker, and the speaker 11S constitutes a secondary speaker. As described above, the speaker 11S serves as the secondary speakers for reproducing the left ear signal and the right ear signal.

The speaker 11LP is driven by the left ear signal SL for stereophonic reproduction (virtual surround). The speaker 11RP is driven by the right ear signal SR for the stereophonic reproduction (virtual surround).

The signal processor 14L processes the left ear signal SL and generates the reversed-phase signal SL' with an adjusted level in such a manner that the speakers 11LP and 11S reproduce the left ear signal with bidirectional directivity as indicated by dashed lines. Note that, to simplify the drawing, the bidirectional directivity of the right ear signal reproduced by the speakers 11RP and 11S (to be described later) are not illustrated.

In addition, the signal processor 14R processes the right ear signal SR and generates the reversed-phase signal SR' with an adjusted level in such a manner that the speakers 11RP and 11S reproduce the right ear signal with bidirectional directivity. An adder 16 adds the reversed-phase signal SL' obtained by the signal processor 14L and the reversed-phase signal SR' obtained by the signal processor 14R. The speaker 11S is driven by the addition signal obtained by the adder 16.

The acoustic device 10G illustrated in FIG. 8 reproduces the left ear signal with bidirectional directivity by using the speakers 11LP and 11S arranged back-to-back. Therefore, with regard to the left ear signal, the level of sound that propagates toward a right ear direction of the listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10G reproduces the right ear signal with bidirectional directivity by using the speakers 11RP and 11S arranged back-to-back. This also makes it possible to reduce a crosstalk component related to the right ear signal in a similar way.

As described above, the acoustic device 10G illustrated in FIG. 8 uses the two speakers arranged back-to-back to reproduce each of the left ear signal and the right ear signal with bidirectional directivity and to reduce crosstalk components. In addition, in this case, the speaker 11S serves as the secondary speakers for reproducing the left ear signal and the right ear signal. Therefore, many loudspeakers such as a speaker array are not necessary for the acoustic device 10G, the acoustic device 10G is not subject to restriction of position with regard to arrangement of speakers unlike in the case of using the speaker array, and it is possible to favorably reduce crosstalk components and achieve favorable stereophonic reproduction (virtual surround).

Eighth Embodiment

Figure 9:
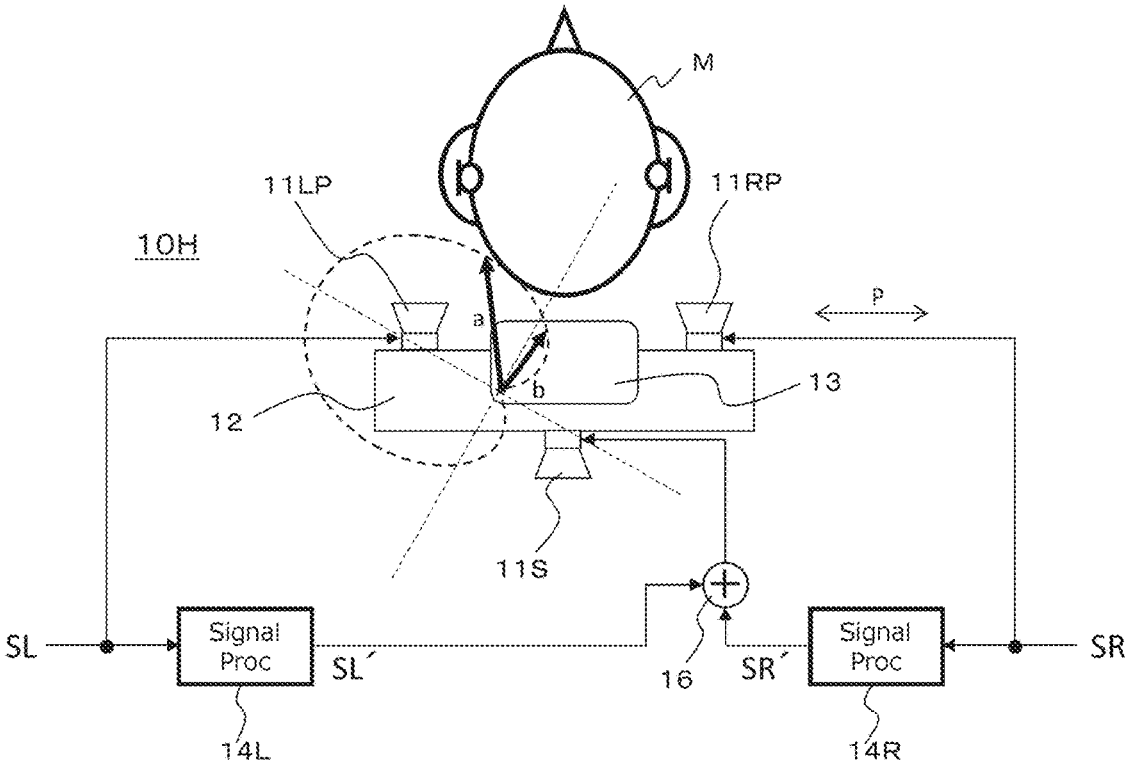
FIG. 9 is a diagram illustrating a configuration example of an acoustic device according to an eighth embodiment.

FIG. 9 illustrates a configuration example of an acoustic device 10H according to an eighth embodiment. In FIG. 9, structural elements similar to FIG. 8 are denoted with the same reference signs as FIG. 8, and detailed description thereof will be omitted appropriately. The acoustic device 10H includes the speaker installation member 12 provided with the speakers 11LP, 11RP, and 11S in a way similar to the acoustic device 10G illustrated in FIG. 8.

The speaker 11LP is driven by the left ear signal SL for stereophonic reproduction (virtual surround). The speaker 11RP is driven by the right ear signal SR for the stereophonic reproduction (virtual surround).

The signal processor 14L processes the left ear signal SL and generates the reversed-phase signal SL' with an adjusted level in such a manner that the speakers 11LP and 11S reproduce the left ear signal with unidirectional directivity as indicated by a dashed line. Note that, to simplify the drawing, the unidirectional directivity of the right ear signal reproduced by the speakers 11RP and 11S (to be described later) are not illustrated.

The signal processor 14R processes the right ear signal SR and generates the reversed-phase signal SR' with an adjusted level in such a manner that the speakers 11RP and 11S reproduce the right ear signal with unidirectional directivity. The adder 16 adds the reversed-phase signal SL' obtained by the signal processor 14L and the reversed-phase signal SR' obtained by the signal processor 14R. The speaker 11S is driven by the addition signal obtained by the adder 16.

The acoustic device 10H illustrated in FIG. 9 reproduces the left ear signal with unidirectional directivity by using the speakers 11LP and 11S arranged back-to-back. Therefore, with regard to the left ear signal, the level of sound that propagates toward a right ear direction of a listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10H reproduces the right ear signal with unidirectional directivity by using the speakers 11RP and 11S arranged back-to-back. This also makes it possible to reduce a crosstalk component related to the right ear signal in a similar way.

As described above, the acoustic device 10H illustrated in FIG. 9 uses the two speakers arranged back-to-back to reproduce each of the left ear signal and the right ear signal with unidirectional directivity and to reduce crosstalk components. In addition, in this case, the speaker 11S serves as the secondary speakers for reproducing the left ear signal and the right ear signal. Therefore, many loudspeakers such as a speaker array are not necessary for the acoustic device 10H, the acoustic device 10H is not subject to restriction of position with regard to arrangement of speakers unlike in the case of using the speaker array, and it is possible to favorably reduce crosstalk components and achieve favorable stereophonic reproduction (virtual surround).

Ninth Embodiment

Figure 10:
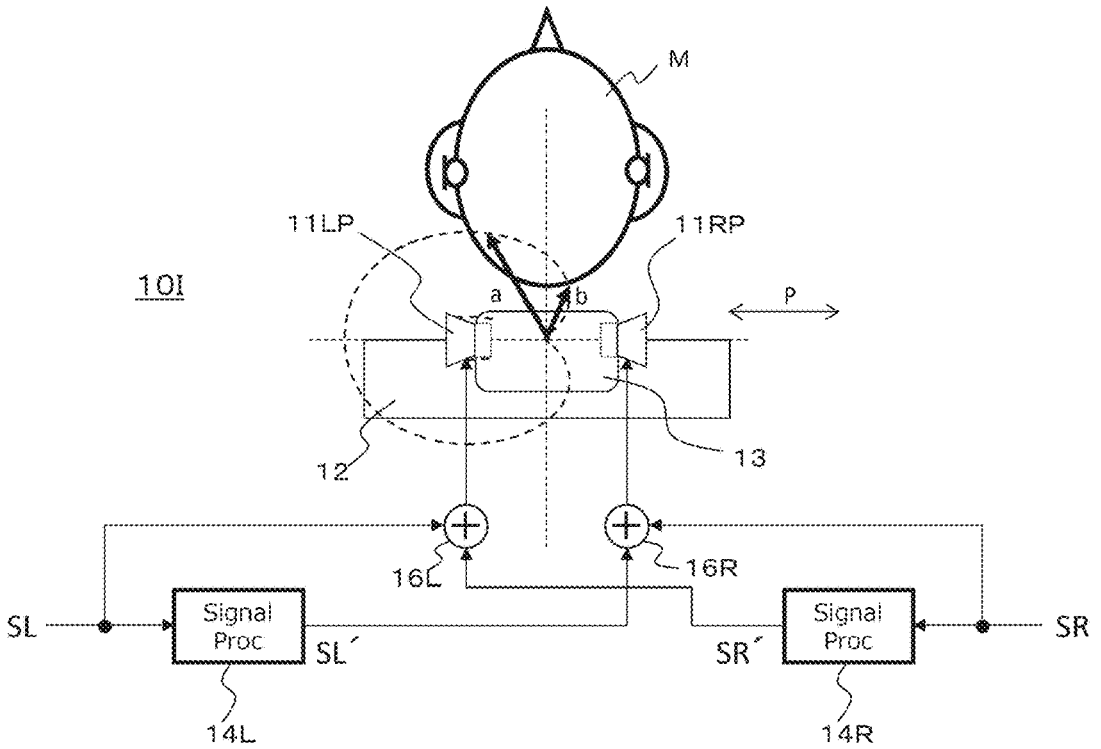
FIG. 10 is a diagram illustrating a configuration example of an acoustic device according to a ninth embodiment.

FIG. 10 illustrates a configuration example of an acoustic device 10I according to a ninth embodiment. In FIG. 10, structural elements similar to FIG. 1 are denoted with the same reference signs as FIG. 1, and detailed description thereof will be omitted appropriately. The acoustic device 10I includes the speaker installation member 12 provided with the speakers 11LP and 11RP. For example, the speaker installation member 12 is fixed to the headrest 13 attached to the upper central portion of the seat back (not illustrated) of the vehicle seat. Note that, the speaker installation member 12 may be fixed to the seat back. Alternatively, the speaker installation member 12 may be integrated with the headrest 13 or the seat back of the seat.

The speaker 11LP is installed on the left front surface of the speaker installation member 12. The speaker 11RP is installed on the right front surface of the speaker installation member 12. Here, the speaker 11LP and the speaker 11RP are arranged at a predetermined interval in a first direction (indicated by an arrow P) corresponding to a left and right direction of a listener M while the headrest 13 is interposed between the speaker 11LP and the speaker 11RP.

The speakers 11LP and 11RP are speakers for reproducing the left ear signal, and the speakers 11LP and 11RP constitute two speakers arranged back-to-back to give directivity. In this case, the speaker 11LP constitutes a primary speaker, and the speaker 11RP constitutes a secondary speaker.

In addition, the speakers 11RP and 11LP are speakers for reproducing the right ear signal, and the speakers 11RP and 11LP constitute two speakers arranged back-to-back to give directivity. In this case, the speaker 11RP constitutes a primary speaker, and the speaker 11LP constitutes a secondary speaker.

As described above, the speaker 11RP that is the primary speaker for reproducing the right ear signal also serves as the secondary speaker for reproducing the left ear signal. Conversely, the speaker 11LP that is the primary speaker for reproducing the left ear signal also serves as the secondary speaker for reproducing the right ear signal.

The signal processor 14L processes the left ear signal SL and generates the reversed-phase signal SL' with an adjusted level in such a manner that the speakers 11LP and 11RP reproduce the left ear signal with unidirectional directivity as indicated by a dashed line. Note that, to simplify the drawing, the unidirectional directivity of the right ear signal reproduced by the speakers 11RP and 11LP (to be described later) are not illustrated.

In addition, the signal processor 14R processes the right ear signal SR and generates the reversed-phase signal SR' with an adjusted level in such a manner that the speakers 11RP and 11LP reproduce the right ear signal with unidirectional directivity. An adder 16L adds the left ear signal SL and the reversed-phase signal SR' obtained by the signal processor 14R. The speaker 11LP is driven by the addition signal obtained by the adder 16L. An adder 16R adds the right ear signal SR and the reversed-phase signal SL' obtained by the signal processor 14L. The speaker 11RP is driven by the addition signal obtained by the adder 16R.

The acoustic device 10I illustrated in FIG. 10 reproduces the left ear signal with unidirectional directivity by using the speakers 11LP and 11RP arranged back-to-back. Therefore, with regard to the left ear signal, the level of sound that propagates toward a right ear direction of a listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10I reproduces the right ear signal with unidirectional directivity by using the speakers 11RP and 11LP arranged back-to-back. This also makes it possible to reduce a crosstalk component related to the right ear signal in a similar way.

As described above, the acoustic device 10I illustrated in FIG. 10 uses the two speakers arranged back-to-back to reproduce each of the left ear signal and the right ear signal with unidirectional directivity and to reduce crosstalk components. In addition, in this case, the speaker 11RP that is the primary speaker for reproducing the right ear signal also serves as the secondary speaker for reproducing the left ear signal. Conversely, the speaker 11LP that is the primary speaker for reproducing the left ear signal also serves as the secondary speaker for reproducing the right ear signal.

Therefore, many loudspeakers such as a speaker array are not necessary for the acoustic device 10I, the acoustic device 10I is not subject to restriction of position with regard to arrangement of speakers unlike in the case of using the speaker array, and it is possible to favorably reduce crosstalk components and achieve favorable stereophonic reproduction (virtual surround).

Tenth Embodiment

Figure 11:
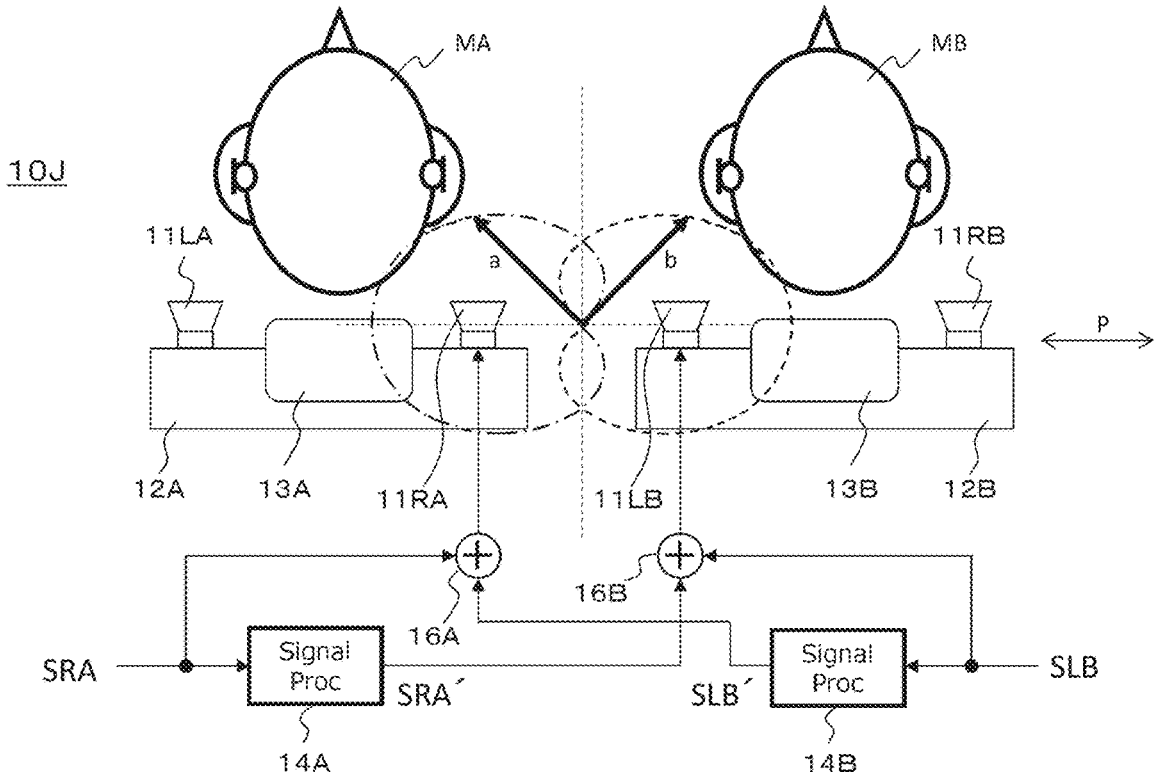
FIG. 11 is a diagram illustrating a configuration example of an acoustic device according to a tenth embodiment.

FIG. 11 illustrates a configuration example of an acoustic device 10J according to a tenth embodiment. In FIG. 11, structural elements similar to FIG. 1 are denoted with the same reference signs as FIG. 1, and detailed description thereof will be omitted appropriately. The acoustic device 10J is assumed to be installed in a movie theater, a theme park (an amusement park, a hot spring), or the like in a state where a plurality of seats is arranged side by side.

Among two adjacent seats, an A-side seat (left-side seat) includes a speaker installation member 12A provided with speakers 11LA and 11RA. Here, the speaker 11LA and the speaker 11RA are arranged at a predetermined interval in a first direction (indicated by an arrow P) corresponding to a left and right direction of a listener MA while a headrest 13A is interposed between the speaker 11LA and the speaker 11RA. The speaker installation member 12A is fixed to the headrest 13A attached to the upper central portion of the seat back (not illustrated) of the seat. Note that, the speaker installation member 12A may be fixed to the seat back. Alternatively, the speaker installation member 12A may be integrated with the headrest 13A or the seat back of the seat. The speaker 11LA is a speaker for reproducing the left ear signal, and the speaker 11RA is a speaker for reproducing the right ear signal.

In addition, among two adjacent seats, a B-side seat (right-side seat) includes a speaker installation member 12B provided with speakers 11LB and 11RB. Here, the speaker 11LB and the speaker 11RB are arranged at a predetermined interval in the first direction (indicated by the arrow P) corresponding to a left and right direction of a listener MB while a headrest 13B is interposed between the speaker 11LB and the speaker 11RB. The speaker installation member 12B is fixed to the headrest 13B attached to the upper central portion of the seat back (not illustrated) of the seat. Note that, the speaker installation member 12B may be fixed to the seat back. Alternatively, the speaker installation member 12B may be integrated with the headrest 13B or the seat back of the seat. The speaker 11LB is a speaker for reproducing the left ear signal, and the speaker 11RB is a speaker for reproducing the right ear signal.

Here, the speakers 11RA of the A-side seat and the speaker 11LB of the B-side seat are speakers for reproducing the right ear signal, and they constitute two speakers arranged back-to-back to give directivity. In this case, the speaker 11RA constitutes a primary speaker, and the speaker 11LB constitutes a secondary speaker. In addition, the speakers 11LB of the B-side seat and the speaker 11RA of the A-side seat are speakers for reproducing the left ear signal, and they constitute two speakers arranged back-to-back to give directivity. In this case, the speaker 11LB constitutes a primary speaker, and the speaker 11RA constitutes a secondary speaker.

The signal processor 14A processes an A-side right ear signal SRA and generates a reversed-phase signal SRA' with an adjusted level in such a manner that the A-side seat reproduces the right ear signal with unidirectional directivity by using the speakers 11RA and 11LB as indicated by a dash-dotted line. The signal processor 14B processes a B-side left ear signal SLB and generates a reversed-phase signal SLB' with an adjusted level in such a manner that the B-side seat reproduces the left ear signal with unidirectional directivity as indicated by a dashed line.

The adder 16A adds the A-side right ear signal SRA and the B-side reversed-phase signal SLB' obtained by the signal processor 14B. The A-side speaker 11RA is driven by the addition signal obtained by the adder 16A. The adder 16B adds the B-side left ear signal SLB and the A-side reversed-phase signal SRA' obtained by the signal processor 14A. The B-side speaker 11LB is driven by the addition signal obtained by the adder 16B.

The acoustic device 10J illustrated in FIG. 11 reproduces the right ear signal of the A-side seat with unidirectional directivity by using the speakers 11RA and 11LB arranged back-to-back. Therefore, with regard to the right ear signal, the level of sound that propagates toward a left ear direction of a listener MB sitting on the B-side seat becomes significantly lower than the level of sound that propagates toward a right ear direction of a listener MA sitting on the A-side seat (indicated by an arrow a), and this makes it possible to reduce a crosstalk component related to the B-side seat.

In addition, the acoustic device 10J reproduces the left ear signal of the B-side seat with unidirectional directivity by using the speakers 11LB and 11RA arranged back-to-back. Therefore, with regard to the left ear signal, the level of sound that propagates toward a right ear direction of the listener MA sitting on the A-side seat becomes significantly lower than the level of sound that propagates toward a left ear direction of the listener MB sitting on the B-side seat (indicated by an arrow b), and this makes it possible to reduce a crosstalk component related to the A-side seat.

Note that, although detailed description will be omitted, the acoustic device 10J illustrated in FIG. 11 reproduces the left ear signal of the A-side seat with unidirectional directivity in a way similar to the reproduction of the left ear signal of the B-side seat. This makes it possible to reduce a crosstalk component related to an adjacent seat. Similarly, although detailed description will be omitted, the acoustic device 10J reproduces the right ear signal of the B-side seat with unidirectional directivity in a way similar to the reproduction of the right ear signal of the A-side seat. This makes it possible to reduce a crosstalk component related to an adjacent seat.

11th Embodiment

Figure 12:
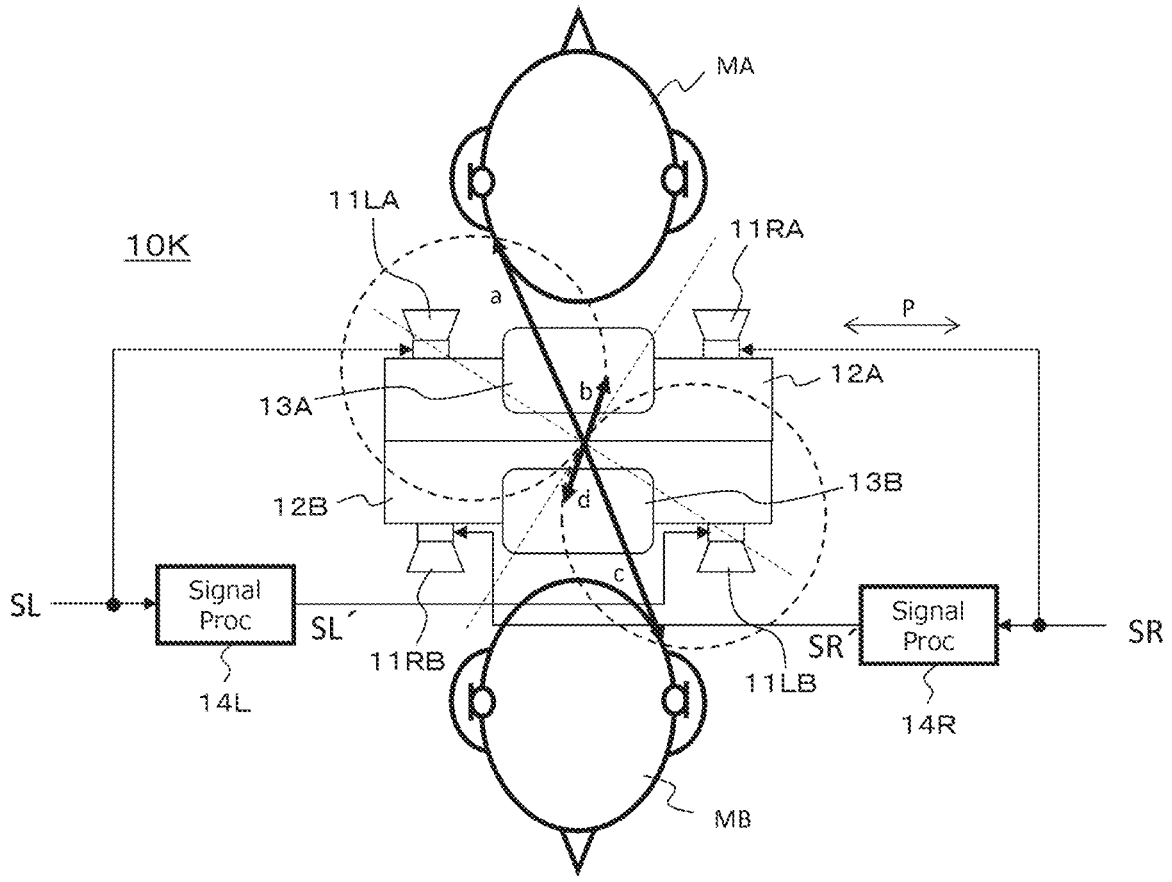
FIG. 12 is a diagram illustrating a configuration example of an acoustic device according to an 11th embodiment.

FIG. 12 illustrates a configuration example of an acoustic device 10K according to an 11th embodiment. In FIG. 12, structural elements similar to FIG. 1 are denoted with the same reference signs as FIG. 1, and detailed description thereof will be omitted appropriately. The acoustic device 10K is assumed to be used for an attraction in a theme park or the like in a state where two seats are arranged back to back.

Among the two seats arranged back to back, The A-side seat includes the speaker installation member 12A provided with the speakers 11LA and 11RA. Here, the speaker 11LA and the speaker 11RA are arranged at a predetermined interval in a first direction (indicated by an arrow P) corresponding to a left and right direction of a listener MA while the headrest 13A is interposed between the speaker 11LA and the speaker 11RA. The speaker installation member 12A is fixed to the headrest 13A attached to the upper central portion of the seat back (not illustrated) of the seat. Note that, the speaker installation member 12A may be fixed to the seat back. Alternatively, the speaker installation member 12A may be integrated with the headrest 13A or the seat back of the seat. The speaker 11LA is a speaker for reproducing the left ear signal, and the speaker 11RA is a speaker for reproducing the right ear signal.

In addition, among the two seats arranged back to back, the B-side seat includes the speaker installation member 12B provided with the speakers 11LB and 11RB. Here, the speaker 11LB and the speaker 11RB are arranged at a predetermined interval in the first direction (indicated by the arrow P) corresponding to a left and right direction of a listener MB while the headrest 13B is interposed between the speaker 11LB and the speaker 11RB. The speaker installation member 12B is fixed to the headrest 13B attached to the upper central portion of the seat back (not illustrated) of the seat. Note that, the speaker installation member 12B may be fixed to the seat back. Alternatively, the speaker installation member 12B may be integrated with the headrest 13B or the seat back of the seat. The speaker 11LB is a speaker for reproducing the left ear signal, and the speaker 11RB is a speaker for reproducing the right ear signal.

Here, the speakers 11LA and 11LB are speakers for reproducing the left ear signal, and the speakers 11LA and 11LB constitutes two speakers arranged back-to-back to give directivity. In this case, the speaker 11LA constitutes a primary speaker, and the speaker 11LB constitutes a secondary speaker.

The speaker 11LA is driven by the left ear signal SL for stereophonic reproduction (virtual surround). The signal processor 14L processes the left ear signal SL and generates the reversed-phase signal SL' with an adjusted level in such a manner that the speakers 11LA and 11LB reproduce the left ear signal with bidirectional directivity as indicated by dashed lines. Note that, to simplify the drawing, the bidirectional directivity of the right ear signal reproduced by the speakers 11RA and 11RB (to be described later) are not illustrated. The speaker 11LB is driven by the reversed-phase signal SL' obtained by the signal processor 14L.

In addition, the speakers 11RA and 11RB are speakers for reproducing the right ear signal, and the speakers 11RA and 11RB constitute two speakers arranged back-to-back to give directivity. In this case, the speaker 11RA constitutes a primary speaker, and the speaker 11RB constitutes a secondary speaker.

The speaker 11RA is driven by the right ear signal SR for the stereophonic reproduction (virtual surround). The signal processor 14R processes the right ear signal SR and generates the reversed-phase signal SR' with an adjusted level in such a manner that the speakers 11RA and 11RB reproduce the right ear signal with bidirectional directivity. The speaker 11RB is driven by the reversed-phase signal SR' obtained by the signal processor 14R.

The acoustic device 10K illustrated in FIG. 12 reproduces the left ear signal with bidirectional directivity by using the speakers 11LA and 11LB arranged back-to-back. Therefore, with regard to the left ear signal, the level of sound that propagates toward a right ear direction of a listener MA sitting on the A-side seat (indicated by an arrow b) becomes lower than the level of sound that propagates toward a left ear direction of the listener MA (indicated by an arrow a), and this makes it possible to reduce a crosstalk component related to the left ear signal. In addition, the left ear signal is a reversed-phase signal, but this signal is also heard by a listener MB sitting on the B-side seat. In this case, the level of sound that propagates toward a right ear direction of the listener MB sitting on the B-side seat (indicated by an arrow d) becomes lower than the level of sound that propagates toward a left ear direction of the listener MB (indicated by an arrow c), and this makes it possible to reduce a crosstalk component related to the left ear signal.

In addition, the acoustic device 10K illustrated in FIG. 12 reproduces the right ear signal with bidirectional directivity by using the speakers 11RA and 11RB arranged back-to-back. Therefore, with regard to the right ear signal, the level of sound that propagates toward the left ear direction of the listener MA sitting on the A-side seat becomes lower than the level of sound that propagates toward the right ear direction of the listener MA, and this makes it possible to reduce a crosstalk component related to the right ear signal. In addition, the right ear signal is a reversed-phase signal, but this signal is also heard by the listener MB sitting on the B-side seat. In this case, the level of sound that propagates toward the left ear direction of the listener MB sitting on the B-side seat becomes lower than the level of sound that propagates toward the right ear direction of the listener MB, and this makes it possible to reduce a crosstalk component related to the right ear signal.

As described above, the acoustic device 10K illustrated in FIG. 12 uses the two speakers arranged back-to-back to reproduce each of the left ear signal and the right ear signal with bidirectional directivity and to reduce crosstalk components. In addition, in this case, the four speakers are installed on the two seat arranged back to back. Therefore, many loudspeakers such as a speaker array are not necessary for the acoustic device 10K, the acoustic device 10K is not subject to restriction of position with regard to arrangement of speakers unlike in the case of using the speaker array, and it is possible to favorably reduce crosstalk components and achieve favorable stereophonic reproduction (virtual surround).

12th Embodiment

Figure 13:
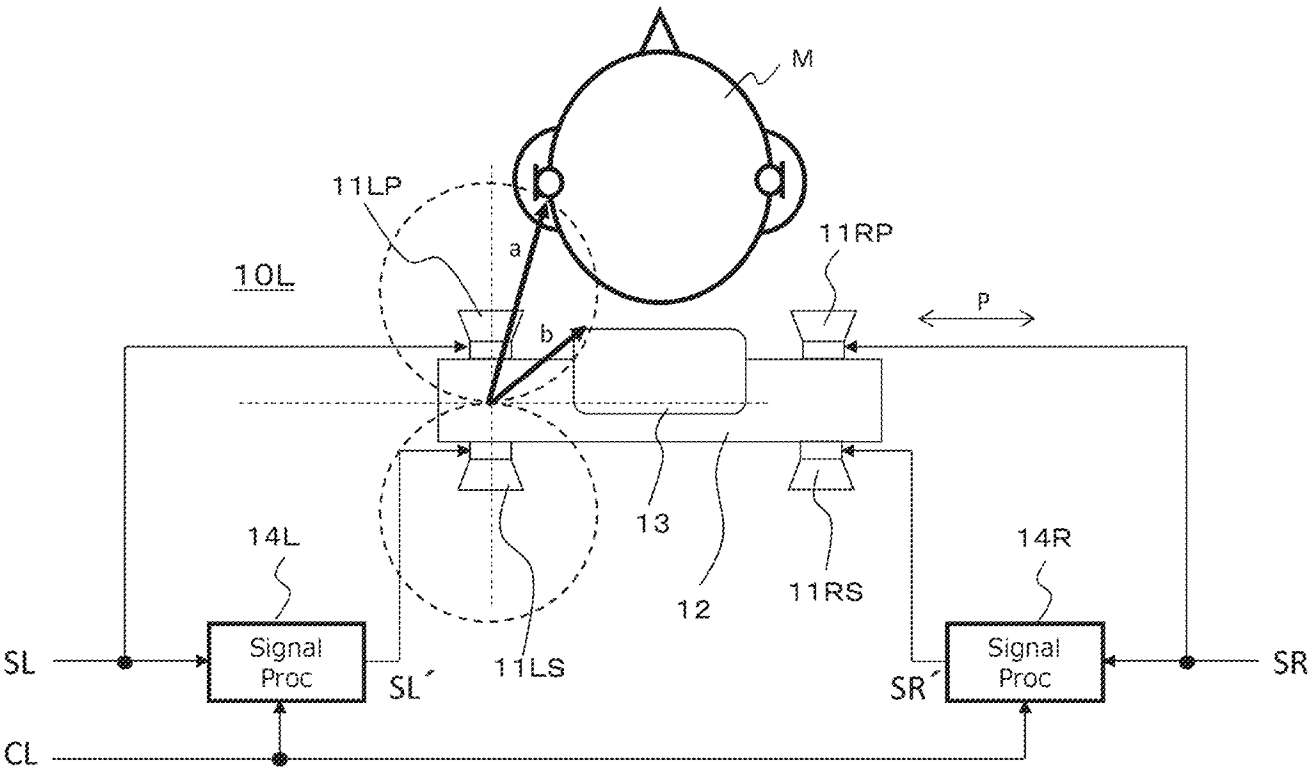
FIG. 13 is a diagram illustrating a configuration example of an acoustic device according to a 12th embodiment.

FIG. 13 illustrates a configuration example of an acoustic device 10L according to a 12th embodiment. In FIG. 13, structural elements similar to FIG. 1 are denoted with the same reference signs as FIG. 1, and detailed description thereof will be omitted appropriately. The acoustic device 10L includes the speaker installation member 12 provided with the speakers 11LP, 11LS, 11RP, and 11RS in a way similar to the acoustic device 10A illustrated in FIG. 1.

The speaker 11LP is driven by the left ear signal SL for stereophonic reproduction (virtual surround). The speaker 11RP is driven by the right ear signal SR for the stereophonic reproduction (virtual surround).

The signal processor 14L processes the left ear signal SL and generates the reversed-phase signal SL' with an adjusted level in such a manner that the speakers 11LP and 11LS reproduce the left ear signal with directivity. Here, the signal processor 14L is capable of switching the processing of generating the reversed-phase signal SL' on the basis of a control signal CL generated through user operation in such a manner that the directivity of the left ear signal becomes bidirectional directivity indicated by dashed lines in FIG. 13 or unidirectional directivity indicated by a dashed line in FIG. 14, for example. Note that, to simplify the drawing, the directivity of the right ear signal reproduced by the speakers 11RP and 11RS (to be described later) are not illustrated. The speaker 11LS is driven by the reversed-phase signal SL' obtained by the signal processor 14L.

In addition, the signal processor 14R processes the right ear signal SR and generates the reversed-phase signal SR' with an adjusted level in such a manner that the speakers 11RP and 11RS reproduce the right ear signal with directivity. Here, in a way similar to the above-described signal processor 14L, the signal processor 14R is also capable of switching the processing of generating the reversed-phase signal SR' on the basis of the control signal CL in such a manner that the directivity of the right ear signal becomes bidirectional directivity or unidirectional directivity. The speaker 11RS is driven by the reversed-phase signal SR' obtained by the signal processor 14R.

The acoustic device 10L illustrated in FIG. 13 reproduces the left ear signal with bidirectional directivity or unidirectional directivity by using the speakers 11LP and 11LS arranged back-to-back. Therefore, with regard to the left ear signal, the level of sound that propagates toward a right ear direction of a listener M (indicated by an arrow b) becomes lower than the level of sound that propagates toward a left ear direction of the listener M (indicated by an arrow a), and this makes it possible to reduce a crosstalk component related to the left ear signal. In addition, the acoustic device 10L reproduces the right ear signal with bidirectional directivity or unidirectional directivity by using the speakers 11RP and 11RS arranged back-to-back. This also makes it possible to reduce a crosstalk component related to the right ear signal in a similar way.

As described above, the acoustic device 10L illustrated in FIG. 13 uses the two speakers arranged back-to-back to reproduce each of the left ear signal and the right ear signal with bidirectional directivity and to reduce crosstalk components. Therefore, many loudspeakers such as a speaker array are not necessary for the acoustic device 10L, the acoustic device 10L is not subject to restriction of position with regard to arrangement of speakers unlike in the case of using the speaker array, and it is possible to favorably reduce crosstalk components and achieve favorable stereophonic reproduction (virtual surround).

In addition, the acoustic device 10L illustrated in FIG. 13 is capable of selectively switching the directivity to be given to the left ear signal and the right ear signal between bidirectional directivity and unidirectional directivity. In this case, the bidirectional directivity makes it possible to reduce the crosstalk components more, but the unidirectional directivity makes it possible to drastically reduce the level of sound that propagates toward the back surface side.

Figure 14:
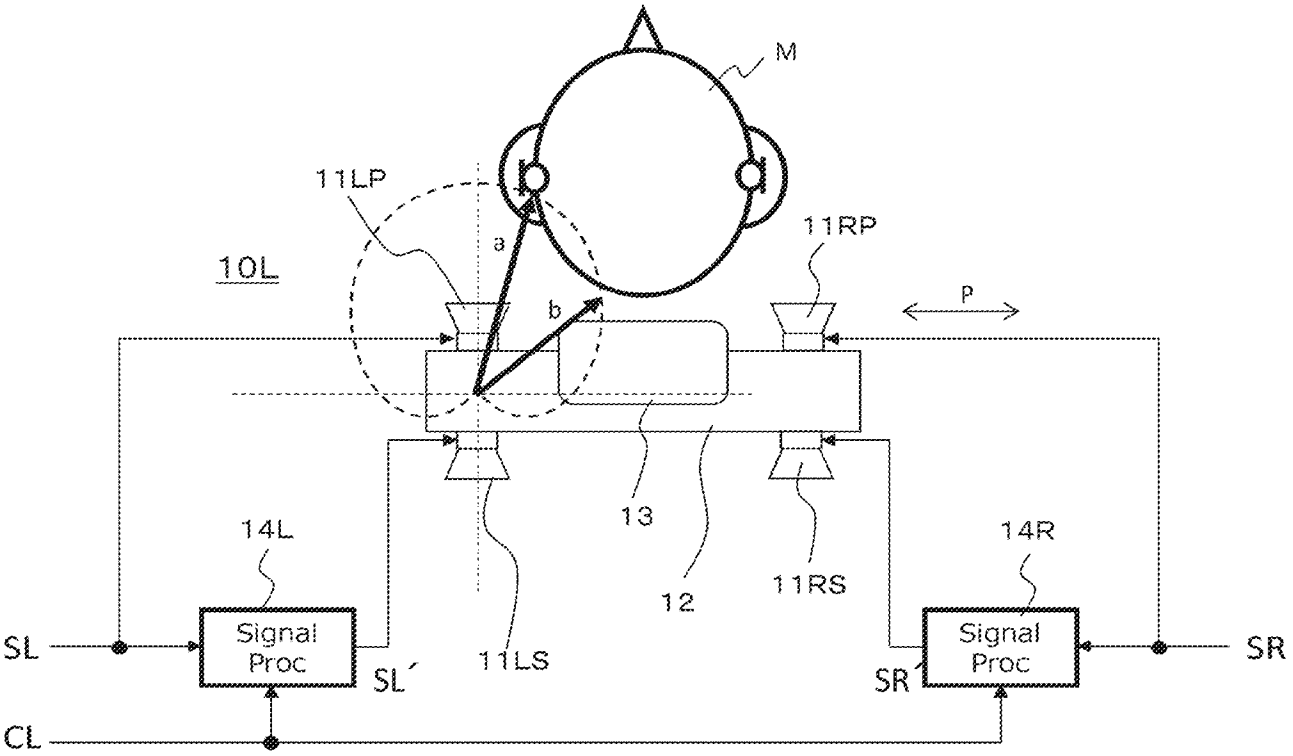
FIG. 14 is a diagram illustrating the configuration example of the acoustic device according to the 12th embodiment.

Note that, although the acoustic device 10L illustrated in FIG. 13 and FIG. 14 corresponds to the acoustic device 10A illustrated in FIG. 1, it is also possible to configure an acoustic device corresponding to the acoustic device 10B or 10C illustrated in FIG. 3 or FIG. 4 in a similar way.

2. MODIFICATION

Note that, according to the above-described embodiments, the bidirectional directivity and the unidirectional directivity have been described as examples of directivity given to the left ear signal and the right ear signal to reduce crosstalk components. However, the directivity is not limited thereto as long as it is possible to reduce the crosstalk components.

In addition, the above-described embodiments disclose the present technology in the form of the exemplifications, and it is obvious that a person skilled in the art can make modifications or substitutions in the embodiments without departing from the subject matter of the present technology. That is, for deciding the subject matter of the present technology, claims should be taken into consideration.

Additionally, the present technology may also be configured as below.

(1) An acoustic device that gives directivity to each of a left ear signal and a right ear signal and reproduces each of the left ear signal and the right ear signal by using at least two respective speakers arranged back-to-back to reduce a crosstalk component.

(2) The acoustic device according to (1), in which the speaker is a speaker installed in a headrest or a seat provided with the headrest.

(3) The acoustic device according to (1) or (2), in which the directivity given to the left ear signal and the directivity given to the right ear signal are bidirectional directivity.

(4) The acoustic device according to (1) or (2), in which the directivity given to the left ear signal and the directivity given to the right ear signal are unidirectional directivity.

(5) The acoustic device according to any of (1) to (4), in which the two speakers arranged back-to-back include a primary speaker and a secondary speaker for forming directivity, a primary speaker for reproducing the left ear signal and a primary speaker for reproducing the right ear signal are arranged at a predetermined interval in a first direction, a secondary speaker for reproducing the left ear signal is arranged at the same position as the primary speaker for reproducing the left ear signal in the first direction, and a secondary speaker for reproducing the right ear signal is arranged at the same position as the primary speaker for reproducing the right ear signal in the first direction.

(6) The acoustic device according to any of (1) to (4), in which the two speakers arranged back-to-back include a primary speaker and a secondary speaker for forming directivity, a primary speaker for reproducing the left ear signal and a primary speaker for reproducing the right ear signal are arranged at a predetermined interval in a first direction, a secondary speaker for reproducing the left ear signal is arranged at a position closer to the primary speaker for reproducing the right ear signal than the primary speaker for reproducing the left ear signal in the first direction, and a secondary speaker for reproducing the right ear signal is arranged at a position closer to the primary speaker for reproducing the left ear signal than the primary speaker for reproducing the right ear signal in the first direction.

(7) The acoustic device according to (6), in which the secondary speaker for reproducing the left ear signal and the secondary speaker for reproducing the right ear signal are the same speaker.

(8) The acoustic device according to any of (1) to (4), in which the two speakers arranged back-to-back include a primary speaker and a secondary speaker for forming directivity, a primary speaker for reproducing the left ear signal and a primary speaker for reproducing the right ear signal are arranged at a predetermined interval in a first direction, a secondary speaker for reproducing the left ear signal is arranged at the same position as the primary speaker for reproducing the right ear signal in the first direction, and a secondary speaker for reproducing the right ear signal is arranged at the same position as the primary speaker for reproducing the left ear signal in the first direction.

(9) The acoustic device according to (1), (2), or (4), in which the two speakers arranged back-to-back include a primary speaker and a secondary speaker for forming directivity, a primary speaker for reproducing the left ear signal and a primary speaker for reproducing the right ear signal are arranged at a predetermined interval in a first direction, the primary speaker for reproducing the left ear signal also serves as a secondary speaker for reproducing the right ear signal, and the primary speaker for reproducing the right ear signal also serves as a secondary speaker for reproducing the left ear signal.

(10) The acoustic device according to any of (1) to (4), in which the two speakers arranged back-to-back include a primary speaker and a secondary speaker for forming directivity, a primary speaker for reproducing the left ear signal and a primary speaker for reproducing the right ear signal are arranged at a predetermined interval in a first direction, a first secondary speaker is arranged at the same position as the primary speaker for reproducing the left ear signal in the first direction and a second secondary speaker is arranged at the same position as the primary speaker for reproducing the right ear signal in the first direction, the first secondary speaker is used as a secondary speaker for middle and high frequencies of the left ear reproduction signal and a secondary speaker for a low frequency of the right ear reproduction signal, and the second secondary speaker is used as a secondary speaker for middle and high frequencies of the right ear reproduction signal and a secondary speaker for a low frequency of the left ear reproduction signal.

(11) The acoustic device according to (10), in which the secondary speaker for the middle and high frequencies forms unidirectional directivity or bidirectional directivity, and the secondary speaker for the low frequency forms bidirectional directivity.

REFERENCE SIGNS LIST

10A, 10B, 10C, 10D, 10E, 10F, 10G, 10H, 10I, 10J, 10K, 10L acoustic device
11LP, 11RP, 11LS, 11RS, 11SA, 11SB, 11S, 11LA, 11RA, 11LB, 11RB speaker
12, 12A, 12B speaker installation member
13, 13A, 13B headrest
14L, 14R, 14LL, 14LH, 14RH, 14RL, 14A, 14B signal processor
15LL, 15RL low-pass filter
15LH, 15RH high-pass filter
16, 16L, 16R, 16A, 16B adder
300 signal processing device
301 sound source reproduction section
302 3D sound image processing section
303 amplifier
M, MA, MB listener

The invention claimed is:

1. An acoustic device that gives directivity to each of a left ear signal and a right ear signal and reproduces each of the left ear signal and the right ear signal by using at least two respective speakers arranged back-to-back to reduce a cross-talk component, wherein the two speakers arranged back-to-back include a primary speaker and a secondary speaker for forming directivity, a primary speaker for reproducing the left ear signal and a primary speaker for reproducing the right ear signal are arranged at a predetermined interval in a first direction, a secondary speaker for reproducing the left ear signal is arranged at a position closer to the primary speaker for reproducing the right ear signal than the primary speaker for reproducing the left ear signal in the first direction, and a secondary speaker for reproducing the right ear signal is arranged at a position closer to the primary speaker for reproducing the left ear signal than the primary speaker for reproducing the right ear signal in the first direction.

2. The acoustic device according to claim 1, wherein a speaker of the two speakers is installed in a headrest or a seat provided with the headrest.

3. The acoustic device according to claim 1, wherein the directivity given to the left ear signal and the directivity given to the right ear signal are bidirectional directivity.

4. The acoustic device according to claim 1, wherein the directivity given to the left ear signal and the directivity given to the right ear signal are unidirectional directivity.

5. An acoustic device that gives directivity to each of a left ear signal and a right ear signal and reproduces each of the left ear signal and the right ear signal by using at least two respective speakers arranged back-to-back to reduce a cross-talk component, wherein the two speakers arranged back-to-back include a primary speaker and a secondary speaker for forming directivity, a primary speaker for reproducing the left ear signal and a primary speaker for reproducing the right ear signal are arranged at a predetermined interval in a first direction, and a single secondary speaker for reproducing the left ear signal and the right ear signal is arranged at a position between the primary speaker for reproducing the left ear signal and the primary speaker for reproducing the right ear signal.

6. An acoustic device that gives directivity to each of a left ear signal and a right ear signal and reproduces each of the left ear signal and the right ear signal by using at least two respective speakers arranged back-to-back to reduce a cross-talk component, wherein the two speakers arranged back-to-back include a primary speaker and a secondary speaker for forming directivity, a primary speaker for reproducing the left ear signal and a primary speaker for reproducing the right ear signal are arranged at a predetermined interval in a first direction, a secondary speaker for reproducing the left ear signal is arranged at the same position as the primary speaker for reproducing the right ear signal in the first direction, and a secondary speaker for reproducing the right ear signal is arranged at the same position as the primary speaker for reproducing the left ear signal in the first direction.

7. An acoustic device that gives directivity to each of a left ear signal and a right ear signal and reproduces each of the left ear signal and the right ear signal by using at least two respective speakers arranged back-to-back to reduce a cross-talk component, wherein the two speakers arranged back-to-back include a primary speaker and a secondary speaker for forming directivity, a primary speaker for reproducing the left ear signal and a primary speaker for reproducing the right ear signal are arranged at a predetermined interval in a first direction, a first secondary speaker is arranged at the same position as the primary speaker for reproducing the left ear signal in the first direction and a second secondary speaker is arranged at the same position as the primary speaker for reproducing the right ear signal in the first direction, the first secondary speaker is used as a secondary speaker for middle and high frequencies of the left ear reproduction signal and a secondary speaker for a low frequency of the right ear reproduction signal, and the second secondary speaker is used as a secondary speaker for middle and high frequencies of the right ear reproduction signal and a secondary speaker for a low frequency of the left ear reproduction signal.

8. The acoustic device according to claim 7, wherein the secondary speaker for the middle and high frequencies forms unidirectional directivity or bidirectional directivity, and the secondary speaker for the low frequency forms bidirectional directivity.

* * * * *